US008534948B2

(12) United States Patent
Thorpe et al.

(10) Patent No.: US 8,534,948 B2
(45) Date of Patent: Sep. 17, 2013

(54) DISPENSER WITH A CAM PATH

(75) Inventors: Timothy Thorpe, Santa Monica, CA (US); Luis Alviar, Santa Monica, CA (US)

(73) Assignee: HCT Asia Ltd, Central (HK)

( * ) Notice: Subject to any disclaimer, the term of this patent is extended or adjusted under 35 U.S.C. 154(b) by 756 days.

(21) Appl. No.: 12/399,421

(22) Filed: Mar. 6, 2009

(65) Prior Publication Data

US 2009/0162131 A1 Jun. 25, 2009

(51) Int. Cl.
*B43K 5/06* (2006.01)

(52) U.S. Cl.
USPC ..... 401/172

(58) Field of Classification Search
USPC ..... 401/172, 268, 270, 277, 279–281
See application file for complete search history.

(56) References Cited

U.S. PATENT DOCUMENTS

| | | | | |
|---|---|---|---|---|
| 118,223 | A | 8/1871 | Evans | |
| 1,065,879 | A | 6/1913 | Krebs | |
| 1,112,193 | A | 9/1914 | Carleton | |
| 1,188,214 | A | 6/1916 | Sohn | |
| 1,355,026 | A | 10/1920 | Austin | |
| 1,358,597 | A | 11/1920 | Tobias | |
| 1,365,246 | A | 1/1921 | Kendall | |
| 1,506,292 | A | 8/1924 | Corsello | |
| 1,626,992 | A | 5/1927 | Willik | |
| 2,990,086 | A | 6/1961 | Williams | |
| 3,256,550 | A * | 6/1966 | Laxalt | 401/141 |
| 3,729,011 | A | 4/1973 | Gleicher | |
| 3,850,183 | A | 11/1974 | Gruska | |
| 4,224,958 | A | 9/1980 | Kaplan et al. | |
| 4,674,537 | A | 6/1987 | Bergmann | |
| 4,906,120 | A | 3/1990 | Sekiguchi et al. | |
| 6,142,695 | A | 11/2000 | Byun | |
| 6,363,948 | B2 | 4/2002 | Choi | |
| 6,418,939 | B1 | 7/2002 | Byun | |
| 6,793,431 | B1 | 9/2004 | Tsai | |
| 6,935,802 | B1 | 8/2005 | Byun | |

(Continued)

FOREIGN PATENT DOCUMENTS

| | | |
|---|---|---|
| CN | 1736816 | 2/2006 |
| CN | 2866193 | 2/2007 |

(Continued)

OTHER PUBLICATIONS

The Chinese Office Action mailed Dec. 5, 2011 for Chinese patent application No. 200810174317.1, a counterpart foreign application of US patent No. 8,047,214, 8 pages.

(Continued)

*Primary Examiner* — Huyen Le
(74) *Attorney, Agent, or Firm* — Lee & Hayes, PLLC

(57) ABSTRACT

A dispenser includes a cam path and a mating guide pin to provide a closed position or an open position for the dispenser. The dispenser is selectively rotatable causing the mating guide pin to travel along a cam path to rotate between slanted, unslanted, and slanted downward positions. The mating guide pin in the cam path causes the open position to allow product delivery and causes the closed position to provide a seal to prevent product leakage. In an implementation, the dispenser is selectively guidable along a helical guide slot to an upward position for product application and to a downward position to retract the applicator. When the dispenser is selectively rotatable along the helical guide slot to a retracted position, the dispenser is in a stored state.

15 Claims, 15 Drawing Sheets

(56) References Cited

U.S. PATENT DOCUMENTS

| | | | |
|---|---|---|---|
| 7,101,107 | B1 | 9/2006 | Byun |
| 7,234,474 | B2 | 6/2007 | Byun |
| 7,237,973 | B1 | 7/2007 | Lou |
| 7,344,327 | B2 | 3/2008 | Gueret |
| D598,655 | S | 8/2009 | Thorpe et al. |
| 7,775,737 | B2 | 8/2010 | Deans et al. |
| 7,794,168 | B2 | 9/2010 | Chang |
| 2003/0024545 | A1 | 2/2003 | Delage |
| 2004/0089318 | A1 | 5/2004 | Tahara |
| 2004/0120753 | A1 | 6/2004 | Gieux |
| 2004/0250833 | A1 | 12/2004 | Jang |
| 2006/0278665 | A1 | 12/2006 | Bennett |
| 2007/0098485 | A1 | 5/2007 | Byun |
| 2007/0158372 | A1 | 7/2007 | Kurek et al. |
| 2008/0264440 | A1 | 10/2008 | Thorpe |

FOREIGN PATENT DOCUMENTS

| | | | |
|---|---|---|---|
| CN | 201131422 | | 10/2008 |
| EP | 1195106 | A1 | 4/2002 |
| GB | 798044 | A | 7/1958 |
| GB | 2404370 | A | 2/2005 |
| GB | 2446039 | A | 7/2008 |
| GB | 2463086 | A | 3/2010 |
| JP | 9056462 | A | 3/1997 |
| JP | 3051335 | U | 6/1998 |
| JP | 2004222853 | A | 8/2004 |
| JP | 2005121103 | A | 5/2005 |
| JP | 2008309807 | A | 5/2010 |
| WO | WO2006101339 | A1 | 9/2006 |

OTHER PUBLICATIONS

CN 3203451, Registered Industrial Design Application (Tianjin Samsung Brushes Ltd.) Oct. 10, 2001.

CN 3401674, Registered Industial Design Application (Tianhin Samsung Brushes Ltd.), Nov. 3, 2004.

Final Office Action for U.S. Appl. No. 12/267,486, mailed on Oct. 28, 2011, Timothy Thorpe, "Dispenser With a Flow-Through Compressible Gasket", 9 pages.

Office action for U.S. Appl. No. 12/267,486, mailed on Jun. 15, 2011, Thorpe et al., "Dispenser With a Flow-Through Compressible Gasket".

Translated Chinese Office Action mailed Mar. 31, 2012 for Chinese patent application No. 200810183968.7, a counterpart foreign application of U.S. Appl. No. 12/267,486, 1 page.

The Chinese Office Action mailed Mar. 30, 2012 for Chinese patent application No. 200810173142.2, a counterpart foreign application of U.S. Appl. No. 12/200,708, 5 pages.

Translated Chinese Office Action mailed May 9, 2012 for Chinese patent application No. 200910003314.6, a counterpart foreign application of US patent No. 7,955,014, 5 pages.

Translated Chinese Office Action mailed Jun. 6, 2012 for Chinese patent application No. 200810174317.1, a counterpart foreign application of US patent No. 8,047,214, 10 pages.

Non-Final Office Action for U.S. Appl. No. 12/200,708, mailed on Mar. 27, 2012, Thorpe et al., "Dispenser With a Flow-Through Compressible Gasket", 9 pages.

Translated Chinese Office Action mailed Nov. 21, 2012 for Chinese patent application No. 200810173142.2, a counterpart foreign application of U.S. Appl. No. 12/200,708, 10 pages.

Translated Chinese Office Action mailed Dec. 4, 2012 for Chinese patent application No. 200810183968.7, a counterpart foreign application of U.S. Appl. No. 12/267,486, 9 pages.

The Great Britain Office Action mailed Jan. 3, 2013 for Great Britain patent application No. 0900737.8, a counterpart foreign application of U.S. Appl. No. 12/267,486, 6 pages.

Translated copy of the Chinese Office Action mailed Jan. 24, 2013 for Chinese patent application No., a counterpart foreign application of US patent No. 8,047,214, 8 pages.

Translated copy of the Chinese Office Action mailed May 10, 2013 for Chinese patent application No. 200810173142.2, a counterpart foreign application of U.S. Appl. No. 12/200,708, 14 pages.

Great Britain Office Action mailed May 15, 2013 for Great Britain patent application No. 0900737.8, a counterpart foreign application of U.S. Appl. No. 12/267,486, 2 pages.

Japanese Office Action mailed May 10, 2013 for Japanese patent application No. 2008-309807, a counterpart foreign application of U.S. Appl. No. 12/267,486, 8 pages.

* cited by examiner

DISPENSER WITH A CAM PATH

BACKGROUND

Devices exist for dispensing cosmetic, medicinal, food, household, or other type products. Such devices usually consist of an outer housing, a delivery mechanism for dispensing the different types of products, and an applicator. For example, in various industries, devices are employed for applying powder, gel, creams, or lotions. In the cosmetics and personal care industries, devices are used to apply lipstick, lip balm, skin creams, lotions, compact powder, loose powder, and other cosmetic products to portions of the face and body.

Typically, these devices have many drawbacks. For example, the product may not be dispensed at a controlled rate, allowing either too little or too much to come out of the device. Another problem is that an applicator on the device may allow product to continue to flow out of the device, once the desired amount of product has been dispensed. For example, the product may leak or spill out of the device, especially when travelling from one location to another for reapplication during the day, resulting in a wasted amount of product and a mess for the user. Accordingly, there remains a need in the art for improved devices.

SUMMARY

This summary is provided to introduce simplified concepts of dispensers with cam paths, which are further described below in the Detailed Description. This summary is not intended to identify essential features of the claimed subject matter, nor is it intended for use in determining the scope of the claimed subject matter.

This disclosure is directed to dispensers with cam paths. The dispenser includes a reservoir for containing a product, a lower valve with at least one aperture, an upper valve having at least one aperture and at least one raised section, and a cam path located on the lower valve. The dispenser also includes a collar with a helical guide slot. The dispenser is selectively guidable in a helical motion along the helical guide slot between an upward position for applying the product and a downward position to store the dispenser. Furthermore, the dispenser is selectively rotatable between a closed position to prevent leakage and an open position for product delivery.

This disclosure is directed to another implementation of a dispenser with a cam path located on the lower valve. The dispenser is selectively guidable in a helical motion along the cam path between: an upward slanted position for the dispenser to be in an open state, wherein the at least one aperture in the lower value is selectively alignable with the at least one aperture in the upper valve, and a flat unslanted position for the dispenser to be in a closed state, wherein the at least one aperture in the lower valve is selectively alignable with the at least one raised section in the upper valve. In other implementations, there is a flow-through compressible gasket.

This disclosure is directed yet to another implementation of a dispenser having a reservoir for containing a product, the lower valve having at least one aperture and an upper valve coupled to the lower valve, the upper valve having at least one aperture and at least one raised section, and at least two cam paths located on the lower valve. The dispenser further includes at least two pins located on the upper valve, each of the pins to travel against each of the cam path. The dispenser being selectively rotatable along the two cam paths and the two pins between: an open position for the dispenser to deliver the product; and a closed position to seal a delivery passageway.

The features, functions, and advantages that have been discussed above or will be discussed below can be achieved independently in various implementations, or may be combined in yet other implementations, further details of which can be seen with reference to the following description and drawings.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

One implementation of this disclosure is directed towards dispensers with at least one cam path in a rotating motion to dispense product and to prevent leakage of the product. For example, a cosmetic dispenser includes a housing having a reservoir for containing a powdered cosmetic product. The dispenser being selectively guidable in a helical motion along a helical guide slot between: an upward position for the dispenser to expose the applicator and a downward position to retract the dispenser. Furthermore, the dispenser being selectively rotatable in a spiral motion along at least one cam path located on a lower valve between i) an open position for the dispenser to deliver the cosmetic product and ii) a closed position to seal a delivery passageway.

In another implementation, a product dispenser includes a cam path located on a lower valve. When the dispenser is selectively rotatable in a spiral motion to an open position to deliver product, a guide pin in an upper valve travels along a cam path in a lower valve, in a downward slant. Also, when the dispenser is selectively rotatable in the spiral motion to the closed position, the guide pin in the upper valve travels along the cam path in the lower valve, in a upward slant to effectively cause a seal by compression. For implementations, the cam path slant upwards may include an open or a closed position and the cam path slant downwards may include an open or a closed position.

In yet another implementation, the dispenser includes at least two cam paths located on the lower valve and two pins located on the upper valve that travel against each of the cam paths. The dispenser being selectively rotatable along the two cam paths between: i) an open position for the dispenser to deliver the product; and ii) a closed position to seal a delivery passageway.

By way of example and not limitation, dispensers with cam paths described herein may be applied in many contexts and environments. For example, dispensers with cam paths may be implemented for medicinal products, cosmetics and personal care industries, powdered cosmetic products, mineral products, food products, spices, carpet deodorizers, baking soda, and the like. For example, in various industries, devices with cam paths may be employed for applying powdered, gel, creams, or lotion products. In the cosmetics and personal care industries, devices with cam paths may be used to apply lipstick, lip balm, skin creams, lotions, powdered, loose powder, and other cosmetic products to portions of the face and body.

Illustrative Flow-Through Dispenser with Helical Actuation

Figure 1:
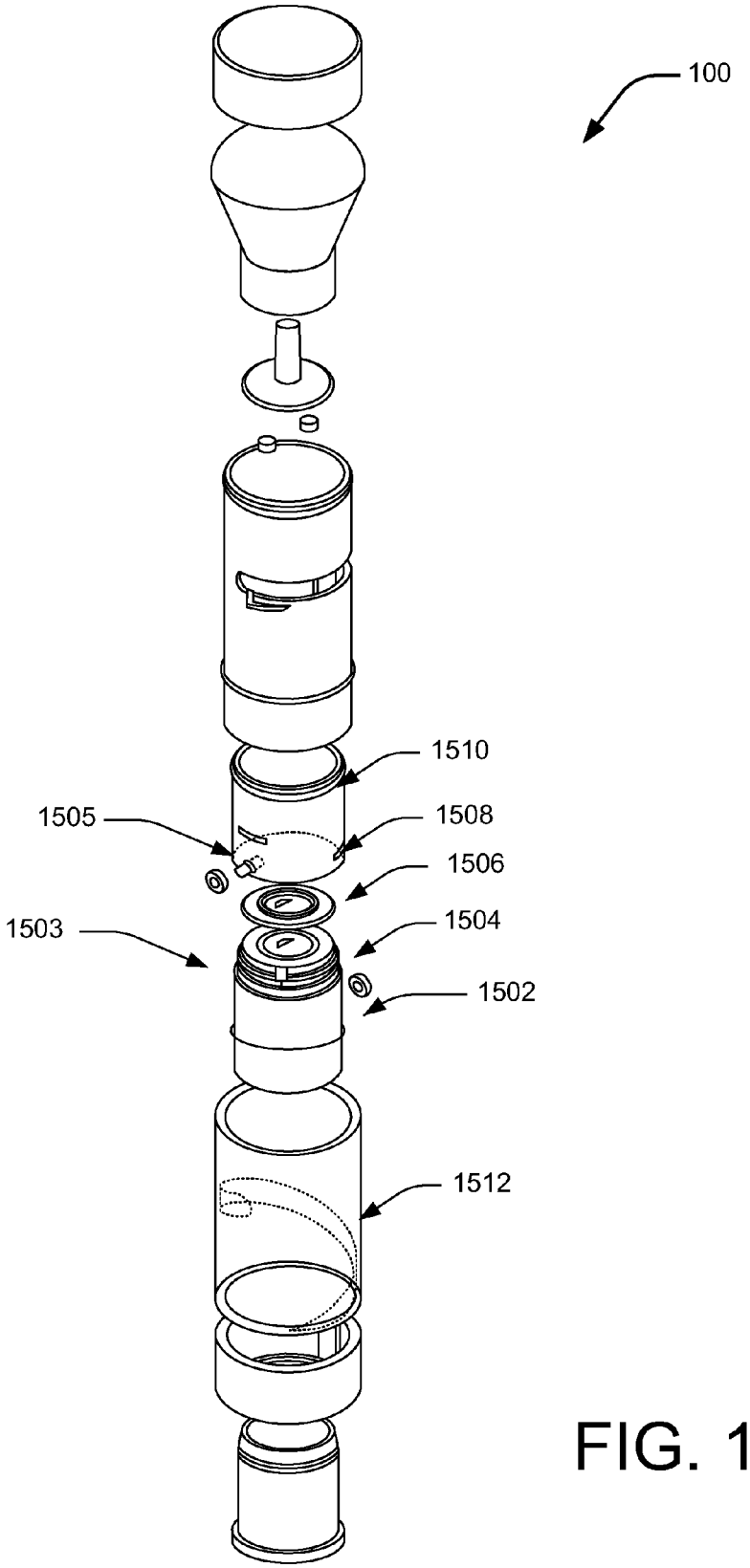
FIG. 1 is an exploded view of an illustrative dispenser with a cam path according to one implementation.

FIG. 1 is an exploded view of an illustrative dispenser with helical actuation and a cam path 100 according to one implementation. In this implementation, the dispenser 100 may be selectively rotatable in a spiral motion between an upward position and a downward position. The upward position may be considered to expose an applicator to apply product. While the downward position may be considered to retract the dispenser, which stores the applicator.

FIG. 1 represents the illustrative dispenser with the cam path 100 having a sleeve 102 with a ridge, the sleeve 102 covers or goes over the various components of the dispenser 100. In some instances, the sleeve 102 may be made of clear, substantially opaque, or translucent materials.

The dispenser with a cam path 100 includes a L-shape path and an end cap 104 coupled to a lower valve 106(*a*) having a reservoir for containing product. The L-shape path is a pattern in the sleeve 102. In some implementations, the lower valve 106(*a*) may be constructed as a separate piece from the reservoir. While in other implementations, the lower valve may be constructed with an attached reservoir as one piece. The lower valve 106(*a*) dimensions include but are not limited to, height from at least about 20 mm to at most about 60 mm and diameter from at least 20 mm to at most about 35 mm. The end cap or refillable cap 104 keeps the product in the reservoir.

The lower valve 106(*a*) may include at least one cam path 106(*b*), a lower guide pin 106(*c*), and a lower valve seat 106(*d*). Travelling along the at least one cam path 106(*b*) is a mating guiding pin (not shown here but in FIG. 2, as 204). The lower guide pin 106(*c*) travels along the L-shape guide, moving the lower valve 106(*a*) in a vertical motion. For example, the lower guide pin 106(*c*) tracks the L-shape vertical slot of the sleeve 102. The terms "lower guide pin" and "mating guide pin" are used to illustrate the two pins are different items that perform different functions. Any term may be used to describe these various pins. As previously mentioned, the dispenser being selectively rotatable in a movement between i) an upward position and ii) a downward position for application of the product.

As described, the dispenser 100 also includes an upper guide pin 109 and an upper valve 110. The upper guide pin 109 is longer than the lower guide pin 106(*c*) and moves in a spiral motion. The upper valve 110 may include an attachment seat 112 that is co-molded together as one piece or may be formed of two separate pieces. The attachment seat 112 may include a plurality of pipes as shown in the figure or alternatively, there may not be any pipes in the attachment seat 112 but would include at least one aperture alternating with at least one or more raised sections. The plurality of apertures in the flow-through compressible gasket 108 is alignable with the plurality of apertures in the lower valve seat 106(*d*) and with the plurality of apertures in the upper valve 110 for product delivery.

The cam path 106(*b*) located on the lower valve 106(*a*) provides a mechanism for mating guide pin located on the underside of the upper valve 110 to selectively rotate the dispenser from open to close positions, states, and vice versa to deliver product and to provide a seal. The mating guide pin on the upper valve 110 travels along the cam path 106(*b*) located on the lower valve, in an upward slant when the dispenser is selectively rotatable in the spiral motion to the closed position. The mating guide pin moving along the cam path 106(*b*) in this upward slanted position rotates to a closed state for no product delivery. There are at least one raised section in the upper valve that is selectively alignable with the at least one aperture in a lower valve to seal the dispenser in the closed state.

The mating guide pin in the upper valve 110 travels along the cam path 106(*b*) in a downward slant when the dispenser is selectively rotatable in the spiral motion to the open position. The mating guide pin in the cam path in this downward slant position is in the open state, which allows for product delivery. There is at least one or more apertures in the upper valve that selectively aligns with the at least one or more apertures of the lower valve to open the dispenser in the open state. For various implementations, the mating guide pin in the cam path slanted upwards, not slanted, or slanted downwards may include either open, closed, or neutral positions, and vice versa.

In some implementations, there is a flow-through compressible gasket 108 to be used with the dispenser. The lower valve 106(*a*) may include a lower valve seat 106(*d*) or a mouth of the lower valve to hold the flow-through compressible gasket 108. The lower valve seat 106(*d*) includes at least one aperture and at least one or more ridges around the external circumference to form a recessed area. The ridge surrounding the lower valve seat 106(*d*) provides a mechanism for the flow-through compressible gasket 108 to attach to the lower valve seat 106(*d*). A more detailed discussion of the flow-through compressible gasket 108 follows in FIGS. 6*a*, 6*b*, and 6*c*.

In implementations with the flow-through compressible gasket 108, the mating guide pin travelling along the cam path 106(*b*) provides a mechanism for the flow-through compressible gasket 108 and the lower valve 106(*a*) to travel to move the dispenser from open to close states and vice versa. This occurs with the dispenser being selectively rotatable in a spiral motion between i) an open position as the open state and ii) a closed position as the closed state. As previously mentioned, the dispenser being selectively rotatable in the rotational motion between i) the upward position and ii) the downward position, along with this spiral motion for the open and closed positions.

In implementations with the flow-through compressible gasket 108, the mating guide pin located on the underside of the upper valve 110 travels along the cam path 106(*b*). This provides the mechanism for the flow-through compressible gasket 108 with the lower valve to rotate the dispenser to the open position. The mating guide pin and the cam path 106(*b*) are in the downward slanted position, when the dispenser is selectively rotatable in the spiral motion to this open position. Here, the flow-through compressible gasket 108 with the lower valve 106(*a*) in this downward slanted position is in the open state to allow for product delivery. There are at least one or more apertures in the upper valve 110 that selectively aligns with the at least one or more apertures of the lower valve 106(*a*), along with the downward slant of the cam path 106(*b*) that decompresses the flow-through compressible gasket 108, to allow the dispenser to be in the open state.

The flow-through compressible gasket 108 with the lower valve 106(*a*) rotates to the closed position when the mating guide pin in the upper valve 110 travels along the cam path 106(*b*) in the upward slanted position. The dispenser is selectively rotatable in the spiral motion to the closed position. The cam path 106(*b*) in this upward slanted position rotates to a closed state for no product delivery. There are at least one raised section in the upper valve 110 that is selectively alignable with the at least one aperture in a lower valve, along with the upward slanted position of the cam path 106(*b*), which increases the effectiveness of a seal by causing a compression against the flow-through compressible gasket 108, to seal the dispenser in the closed state. For various implementations, the cam path slanted upwards or downwards may include either open or closed positions and vice versa. The rotation for the spiral motion may be clockwise or counter clockwise for the open or closed positions.

As mentioned above, the lower valve 106(*a*), the flow-through compressible gasket 108, and the upper valve 110 are capable of being selectively rotatable when the mating guide pin travels along the cam path in the spiral motion to the open position for product delivery. This rotation allows at least one pipe or one aperture in the upper valve 110 being selectively alignable with the at least one aperture in the flow-through compressible gasket 108 and being selectively alignable with the at least one aperture in the lower valve seat 106(*c*), along with the cam path in the downward slanted position to decompress the flow-through gasket 108, to operate in the open position to deliver product. This downward slanted position of the cam path 106(*b*) operates in the open position.

This spiral rotation mechanism may range from at least about ten degrees to at most about 359 degrees. In some implementations, the spiral rotation mechanism may range from at least about 15 degrees to at most about 300 degrees. Furthermore, the flow-through compressible gasket 108 allows a controlled rate of product to be dispensed at one time without product being distributed all over the user or creating a mess in a purse or a carrying type device.

The compressible gasket 108, and the upper valve 110 may have shapes that include but are not limited to, substantially circular-shaped, substantially square-shaped, or substantially oval-shaped. The number of apertures in the lower valve seat 106(*c*), the flow-through compressible gasket 108, and the upper valve 110 may range from at least about one to at most about five apertures. The size of the apertures in the lower valve seat 106(*c*), the flow-through compressible gasket 108, and the upper valve 110 is of a sufficient size and of an adequate opening to allow for product delivery without being plugged. For example, the size of the apertures may range from at least about 1 mm to at most about 6 mm. In one implementation, each aperture is at least about 2.5 mm in size. The configuration of the apertures may range from three apertures positioned at 120 degrees apart from each other. In another implementation, the configuration of the apertures may range from four apertures positioned at 90 degrees apart from each other. The shape, number, and size of the apertures in the lower valve seat 106(*c*), the flow-through compressible gasket 108, and the upper valve 110 may be different in relation to each other.

The at least one pipe in the attachment seat 112 may range in length from at least about 5 mm to at most about 50 mm and may range in diameter from at least about 1 mm to at most about 7 mm. The number and the diameter size of the pipes and the number and diameter size of the raised sections on the upper valve 110 may be similar or not similar in the number and diameter size of apertures in the flow-through compressible gasket 108 and the lower valve seat 106(*c*). In an implementation, a similar size diameter for the apertures on the flow-through compressible gasket 108 and pipes on the attachment seat 112 allows for product delivery while having a similar size diameter of the raised sections on the upper valve 110 and with the plurality of apertures in the flow-through compressible gasket 108 prevents product leakage. In other implementations, there may be alternate different mechanisms to deliver product and to prevent product leakage.

The lower valve 106(*a*) may be secured to the end cap 104 and to the upper valve 110, by, for example, a press-fit, a snap-fit, adhesive, and/or engagement by one or more engagement features. In the illustrated implementation, the lower valve 106(*a*) may include ribs to couple to the upper valve 110.

Shown in FIG. 1 is a collar 114 that goes over the sleeve 102 of the dispenser 100. Shown is a helical spiral guide in the collar 114 that selectively guides the dispenser 100 in a rotational motion between the upward position and the downward position. The dispenser may include the upper guide pin 109 located on the upper valve 110 and the lower guide pin 106(*c*) located on the lower valve, the upper guide pin 109 being selectively rotatable along the helical guide slot. This spiral motion mechanism may range from at least about one degrees to at most about 359 degrees. In some implementations, the spiral rotation mechanism may range from at least about 15 degrees to at most about 250 degrees.

The sleeve 102, the end cap 104, the lower valve 106(*a*), the upper valve 110, the pipes 112, and the collar 114 may be constructed of materials including, but not limited to, wood, plastics, polymers, thermoplastics, aluminum, steel, brass, bronze, various metals, composites thereof, or the like. In some implementations, the sleeve 102, the end cap 104, the lower valve 106(*a*), the upper valve 110, the pipes 112, and the collar 114 may be made at least partially of a resin such as, for example, acrylonitrile butadiene styrene (ABS), styrene acrylonitrile (SAN), pentachlorothioanisole (PCTA), polypropylene (PP), polyethylene (PE), Polyurethane, combinations thereof, or the like.

The flow-through dispenser with helical actuation may include a lock type mechanism to avoid accidentally moving the dispenser into a spiral motion. For example, the dispenser will not selectively rotate from the upward open position to the downward closed position and vice versa, unless a user manually rotates the dispenser.

Illustrative Applicator and Cap for Dispenser with Cam Path

FIG. 1 shows the flow-through dispenser with cam path 100, which includes an attachment fixture 116 that is coupled to the attachment seat 112 and the upper valve 110. The attachment fixture 116 includes at least one aperture selectively alignable with the at least one pipe from the attachment seat 112 for product delivery. The attachment fixture 116 may include at least one aperture that would function as sleeves to go over the pipes on the attachment seat 112 of the upper valve 110.

In implementations with no pipes, the attachment fixture 116 may include at least one aperture that aligns with the at least one aperture in the attachment seat 112. The aperture may range in number from at least about one to at most about six apertures. The aperture may range in size from at least about 1 mm to at most about 7 mm in diameter. The number and diameter size of the apertures in the attachment fixture 116 may match the number and diameter size of the apertures or pipes in the attachment seat 112.

The attachment fixture 116 is coupled to a bottom of an applicator 118. The applicator 118 may include but is not limited to, a brush, a sponge, or a powder puff to apply the product. In some implementations, the applicator may be used to apply products including but not limited to, cosmetic powdered products, gel or lotion products, and the like. While features of various illustrative implementations are described, the applicator 118 may be configured in any form suitable for the application of the product contained in the dispenser. For example, the applicator 118 may be constructed in any other suitable shape and size and may have any suitable mass, surface finish, and/or surface treatment desired for a given application. In practice, the applicator 118 may be configured in virtually any desired shape, such as disk-shaped, oval, elliptical, spherical, curvilinear, trapezoidal, or the like.

As mentioned, the dispenser 100 is capable of being selectively rotatable in the spiral motion to the upward position and selectively rotatable in the spiral motion to the open position. The upward position allows the applicator 118 to be selectively rotatable raised or exposed to deliver product, while the open position allows product to be dispensed through the applicator 118. Also, the dispenser 100 is capable of being selectively rotatable in the spiral motion to a downward position and selectively rotatable in the spiral motion to the closed position. This downward position allows the applicator 118 to be selectively retractable for storing the dispenser, not providing a delivery mechanism and the closed position creates a seal to prevent product from being delivered.

The flow-through dispenser with spiral actuation 100 may include a removable cap 120 or a cover that is sized and shaped to fit over the top of the brush applicator 118. In an implementation, the removable cap 120 may snap onto the collar 114. In another implementation, the removable cap 120 may include threads to screw onto the collar 114 that mates with it. In other implementations, the flow-through dispenser with helical actuation 100 may include a clear plastic cover, a sliding pull up cover, and the like. In this illustration, the dispenser 100 includes the removable cap 120 that encapsulates the brush applicator 118 when the dispenser 100 is not in use. In another implementation, the dispenser 100 may not include a removable cap or cover.

The removable cap 120 may include a mirror (not shown) for convenience of the user to have the mirror readily available when applying the product. The mirror may range in thickness from at least about 0.4 mm to at most about four mm. The mirror may be located on the top, the side, or inside the removable cap 120. In another implementation, the dispenser 100 may not include a mirror.

While features of various illustrative implementations are described, in other implementations, the sleeve 102, the end cap 104, the lower valve 106(*a*), the upper valve 110, the collar 114, the attachment fixture 116, the brush applicator 118, the cap 120, and the mirror may be configured in any form suitable for the application of the product contained in dispenser 100. For example, the above items listed may be constructed in any other suitable shape and size and may have any suitable mass, surface finish, and/or surface treatment desired for a given application. In practice, the above items listed may be configured in virtually any desired shape, such as disk-shaped, oval, elliptical, spherical, curvilinear, trapezoidal, or the like.

Figure 2:
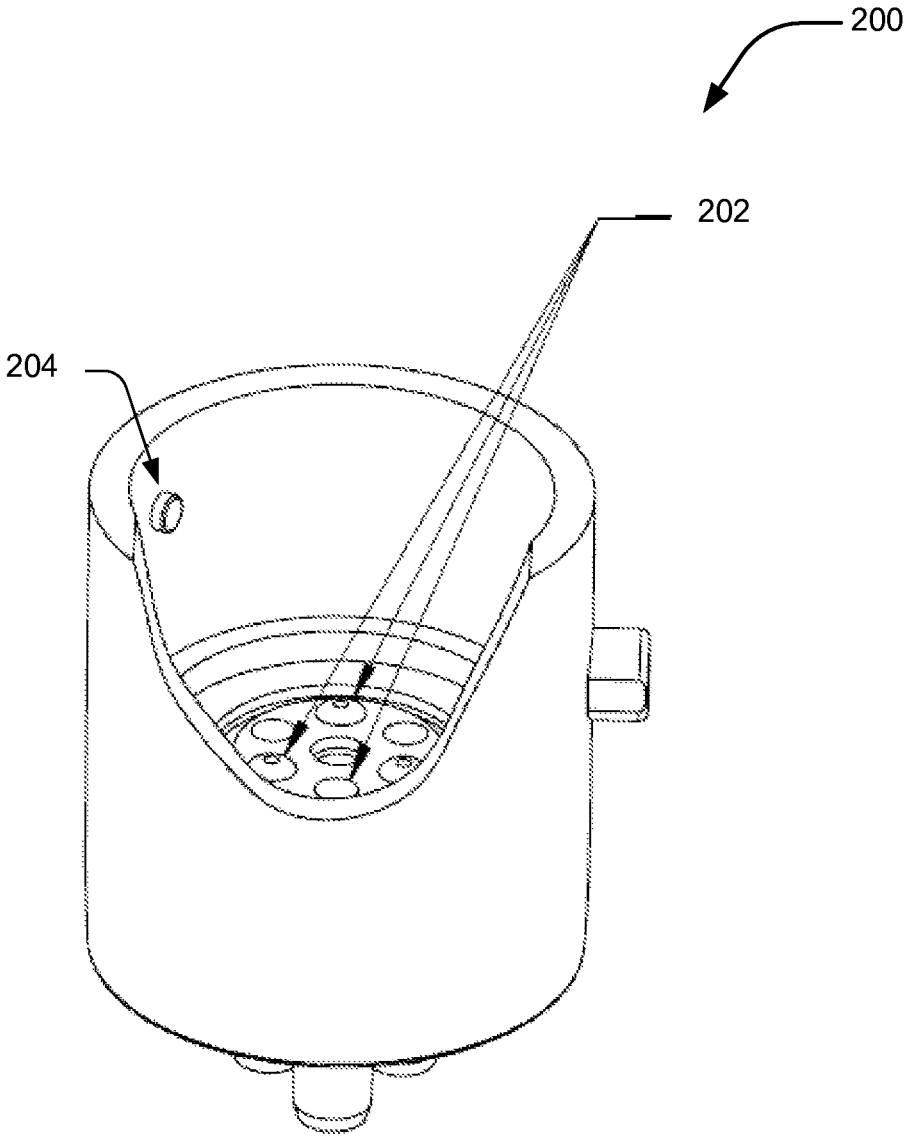
FIG. 2 is a perspective view of an exemplary upper valve illustrating at least one raised sections in an upper valve.

FIG. 2 represents a perspective view of an exemplary upper valve 200. Shown are at least one or more raised sections 202 in the upper valve 110 for the dispenser 100. There are at least one or more raised sections 202 alternating with the at least one or more apertures. Shown is at least one mating guiding pin 204 located on the underside of the upper valve 200. As previously mentioned, the at least one mating guiding pin 204 travels along the cam path 106(*b*). In implementations, there may be several guiding pins.

Figure 3:
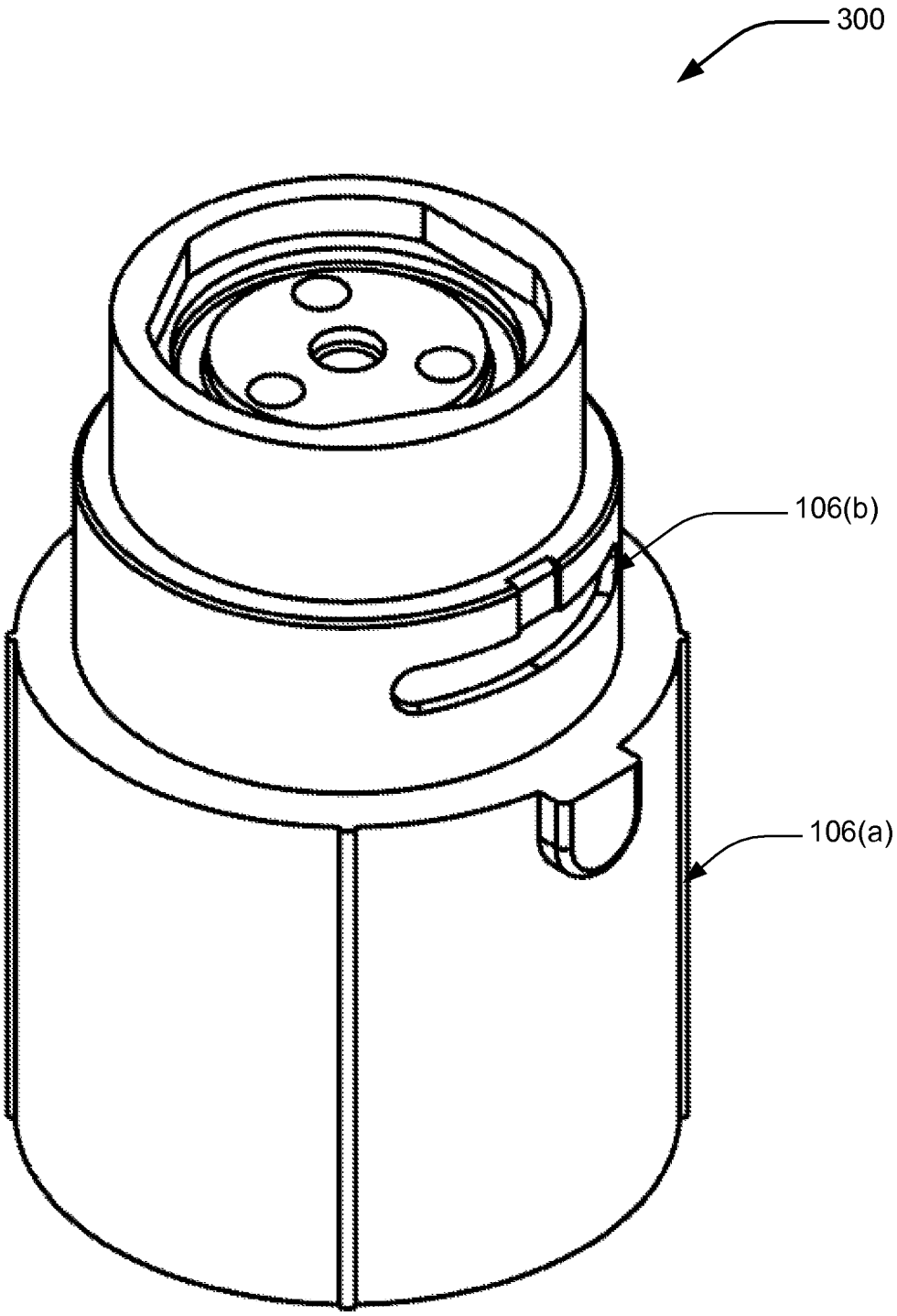
FIG. 3 is a perspective view of an exemplary cam path located on a lower valve.
Figure 4:
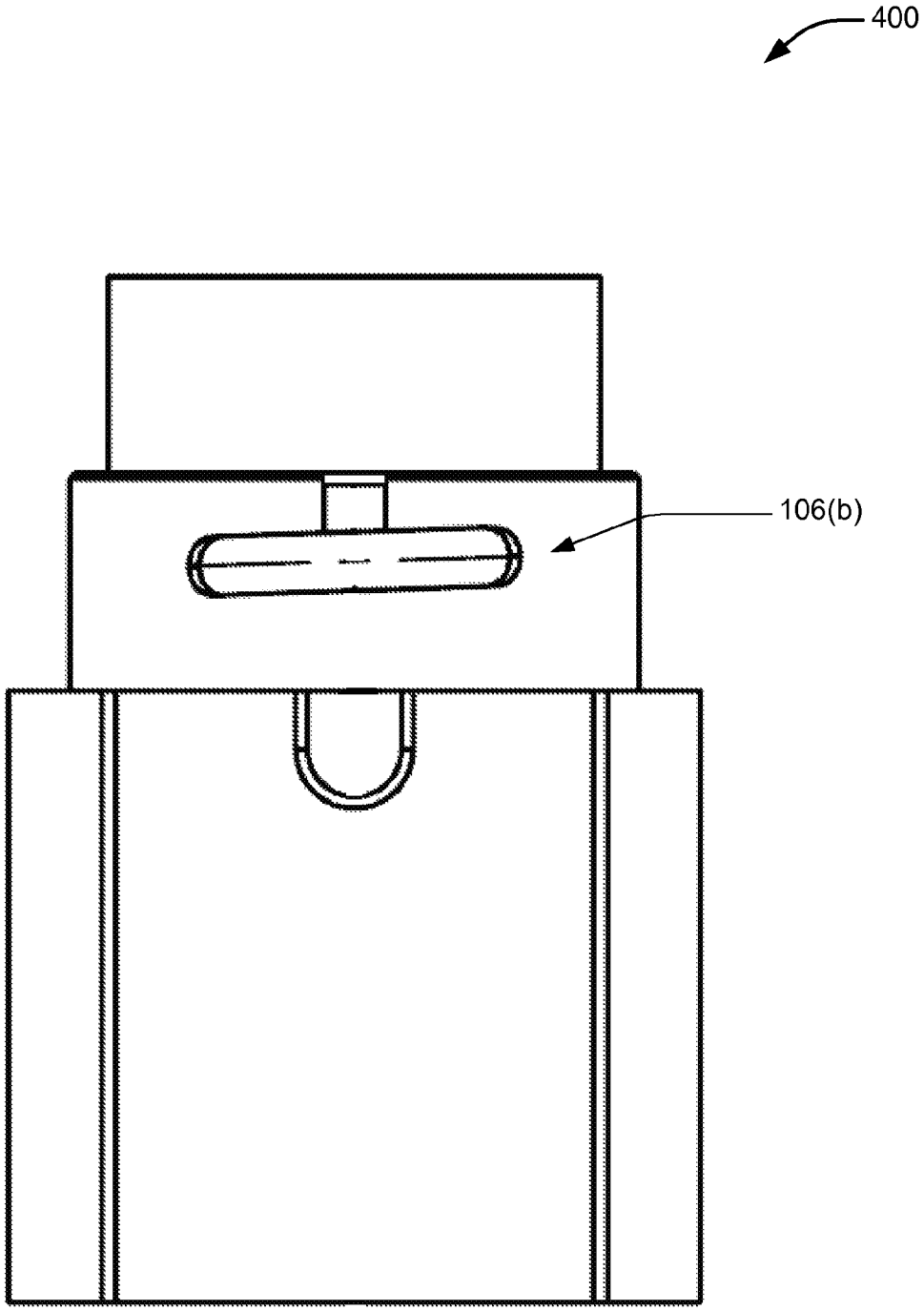
FIG. 4 is a perspective view the exemplary cam path for the dispenser of FIG. 1.

FIGS. 3 and 4 illustrate the exemplary cam path on the lower valve taken from different views. FIG. 3 is a perspective view 300 of the exemplary cam path 106(*b*) located on the lower valve 106(*a*). FIG. 4 is a side view 400 of the exemplary cam path 106(*b*) for the dispenser 100 of FIG. 1. In FIG. 4, the slanted position is shown from left to right, as slanting upwards for the cam path. In other implementations, the slant may be from right to left, slanting upwards for the cam path.

Illustrative Mechanisms Using the Flow-Through Compressible Gasket

Figure 5A:
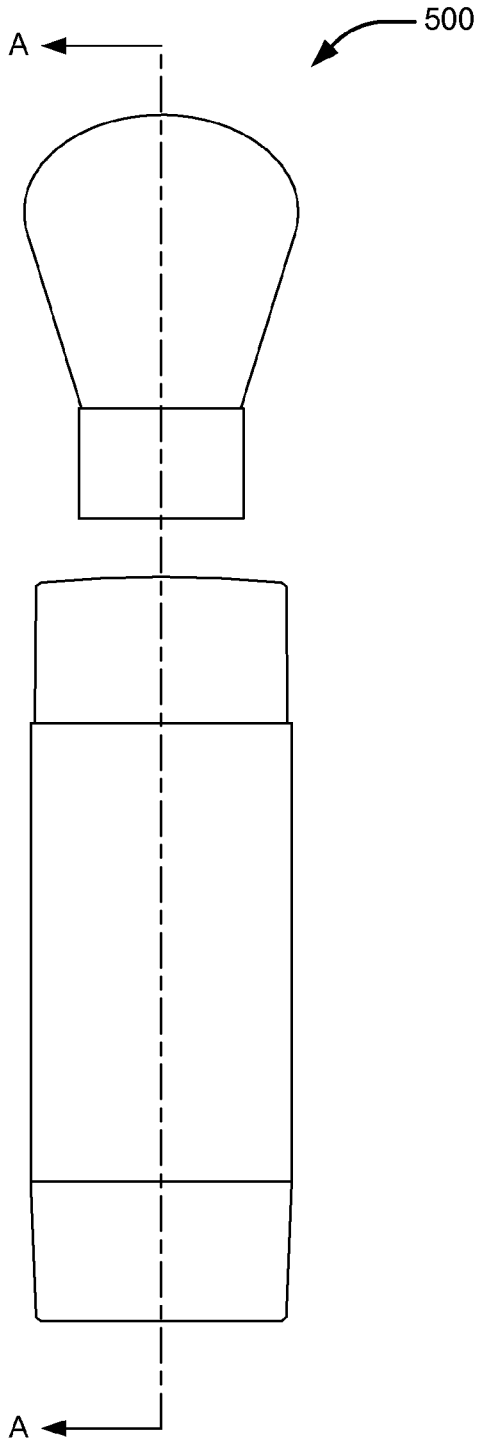
FIGS. 5*a* and 5*b* are cross-sectional views, taken along line A—A of the illustrative dispenser of FIG. 1.
Figure 5B:
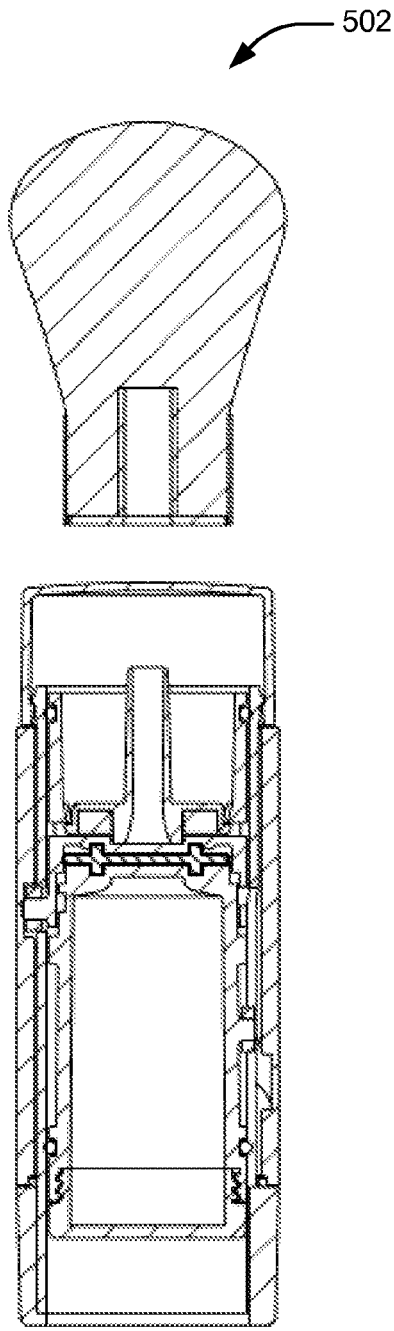

FIGS. 5*a* and 5*b* are a side view 500 and a cross-sectional view 502, respectively, taken along line A-A of the illustrative dispenser of FIG. 1. The following is a discussion of examples, without limitation, of delivery mechanisms for dispensing the product in the open position and of preventing product leakage in the closed position. The positions may be implemented using a rotation or a reverse rotation operation, whereby the user may operate the dispenser 100 by rotating the dispenser in either a clockwise or a counterclockwise direction. The rotations may move from left to right and right to left. The opened and closed positions may apply to rotations which include but are not limited to, clockwise and/or counterclockwise directions, left and/or right movements, up and/or down motions, and the like.

The size of the apertures in the lower valve, the flow-through compressible gasket 108, and the upper valve 110 is of a sufficient size and of an adequate opening to allow for product delivery without being plugged. For example, the size of the apertures may range from at least about one mm to at most about seven mm. In one implementation, each aperture is at least about 2.5 mm in size.

The configuration of the apertures may range from two or three apertures positioned at 120 degrees apart from each other. In another implementation, the configuration of the apertures may range from four apertures positioned at 90 degrees apart from each other. Yet in another implementation, there may be one aperture located in a center or off-center of the lower valve, the flow-through compressible gasket, or the upper valve. The apertures may be located at angles ranging from about 45 degrees apart to about 180 degrees.

The number of apertures in each element may range from at least one aperture to about four apertures. As mentioned above, the number of raised sections may alternate with the number of apertures in the lower valve or the upper valve.

The shape, size, and number of the apertures in the lower valve, the flow-through compressible gasket 108, and the upper valve 110 may be different in relation to each other. For example, there may be one aperture in the flow-through compressible gasket and two apertures in each of the upper valve and the lower valve. Furthermore, the shape of the aperture(s) in the flow-through compressible gasket may be circular shape, in the lower valve may be oval shape, and in the upper valve trapezoid shape. Any combination of shapes, size, and number of apertures are possible.

Illustrative Flow-Through Compressible Gasket

Figure 6A:
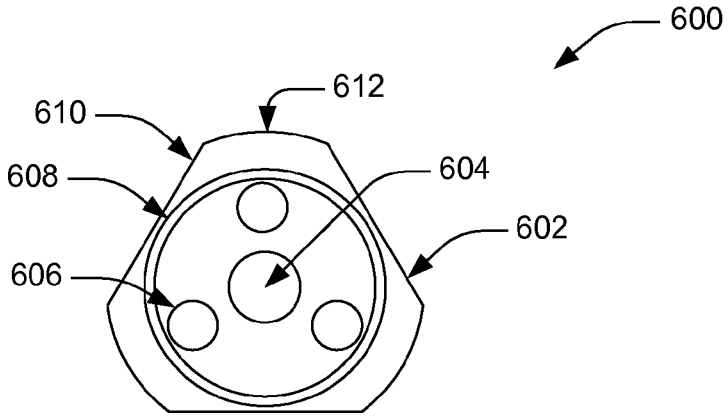
FIGS. 6*a*, 6*b*, and 6*c* are a bottom plan view, a top view, and a perspective view, respectively, of a flow-through compressible gasket.
Figure 6B:
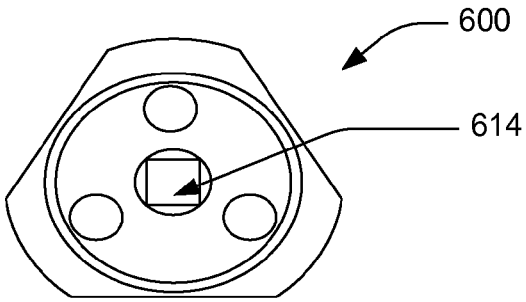
Figure 6C:
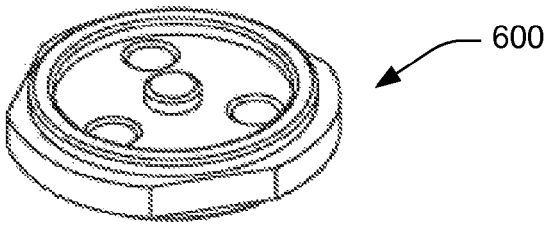

FIGS. 6*a*, 6*b*, and 6*c* are a bottom view, a top plan view, and a perspective view respectively, of an illustrative flow-through compressible gasket 108 according to one implementation. FIG. 6*a* illustrates the flow-through compressible gasket 600 having a substantially disk-shaped body 602 with a top raised center section on a top side 604. The top raised center section 604 may be substantially circular-shape, substantially square-shape, or substantially oval-shape. In this illustration, the top raised center section 604 is substantially circular-shape. The top center-raised section 604 may correspond to a depression on the mating side, the depression located on either the lower valve or the upper valve.

FIG. 6*a* shows the at least one aperture 606 located on the substantially disk-shaped body 602. The at least one aperture 606 aligns with the at least one aperture of the lower valve 106 and/or upper valve 110 or in some implementations with the plurality of pipes in the upper valve to deliver the powdered product. The apertures 606 in the flow-through compressible gasket 600 may have shapes that includes but are not limited to, substantially circular-shape, substantially square-shape, or substantially oval-shape. Shown are apertures 606 that are substantially circular-shape.

The size of the at least one aperture 606 are of a sufficient size to allow for product delivery without being plugged. The size of the aperture is of an adequate opening to allow the powdered particles to travel through at least one aperture 606. For example, the size of the apertures 606 in the flow-through compressible gasket 600 may range from at least about one mm to at most about seven mm. In one implementation, the aperture 606 is at least about 2 mm diameter in size.

The number of the at least one aperture 606 are of a sufficient number to allow for product delivery in the open position, but is somewhat dependent on the size of the apertures. In an implementation, there may be three apertures as shown. In other implementations, the apertures may include but is not limited to, from at least about one aperture to at most about four apertures.

The arrangement of the apertures 606 may be in a triangular configuration as shown. In another implementation, the arrangement may be in various configurations, including but not limited to a square, a circular or hour-glass configuration.

The substantially disk-shaped body 602 includes a circular ring 608 on each side of the disk-shaped body 602. In one implementation, a first circular ring surrounds the apertures and is to couple to the lower valve 106 on one side and a second circular ring surrounds the apertures and is to couple to the upper valve 110 on the outer side.

The flow-through compressible gasket 600 includes an outer perimeter having a plurality of flat sides 610 and a plurality of semicircular sides 612, alternating, on the substantially disk-shape body. The plurality of semicircular sides 612 holds the flow-through compressible gasket 600 secure against the upper valve 110 or the lower valve 106 upon actuation in the various implementations. The plurality of flat sides 610 may apply to any sides of the substantially disk-shaped body 602. For example, the flat sides 610 may include, but is not limited to three sides arranged in a triangle type formation or configuration. The semicircular side 612 may apply to any sides of the substantially disk-shaped body 602.

The semicircular sides 612 arranged in a triangle type formation or configuration. In an implementation, the substantially disk-shaped body 602 may include alternating flat sides 610 with alternating semicircular sides 612. The number of semicircular sides and flat sides may each range from at least about one to the most about four.

FIG. 6*b* shows the other side of the substantially disk-shaped body 602 of the flow-through compressible gasket. The center raised section 614 in the flow-through compressible gasket 600 may be substantially squared-shape. The center-raised section 614 may have shapes that includes but are not limited to, substantially circular-shape, substantially square-shape, or substantially oval-shape. The center-raised section 614 may correspond to a depression on the mating side, the depression located on either the lower valve or the upper valve.

FIG. 6*c* shows a perspective view of the flow-through compressible gasket 600. The flow-through compressible gasket 600 is made of a material capable of having elastomeric properties. The materials include but are not limited to, a thermoplastic elastomer (TPE), a thermoplastic polymer, a polyvinyl chloride, a polyurethane, polyester copolymer, styrene copolymer, olefin, ethylene acrylic, chlorinated polyethylene, chlorosulfonated polyethylene, fluorocarbon, rubber, while in other implementations, the elastomeric material may comprise a relatively pliable or gel-like material such as butyl rubber, silicone, butadiene rubber, neoprene, nitrile, fluorosilicone, styrene-butadiene rubber (SBR), or the like.

While features of various illustrative implementations are described, in other implementations, the flow-through compressible gasket 600 may be configured in any form suitable for the application of the product contained in the dispenser. For example, the flow-through compressible gasket 600 may be constructed in any other suitable shape and size and may have any suitable number of apertures, size of apertures, shape of apertures desired for a given application. The size, number, and shape of the apertures on the flow-through compressible gasket 600 may vary between implementations. Fabrication of the dispenser and the flow-through compressible gasket 600 may be accomplished through a separate manufacturing process, a co-molding process, or any other suitable production process.

An Illustrative Dispenser with a Cam Path in an Actuator

Figure 7:
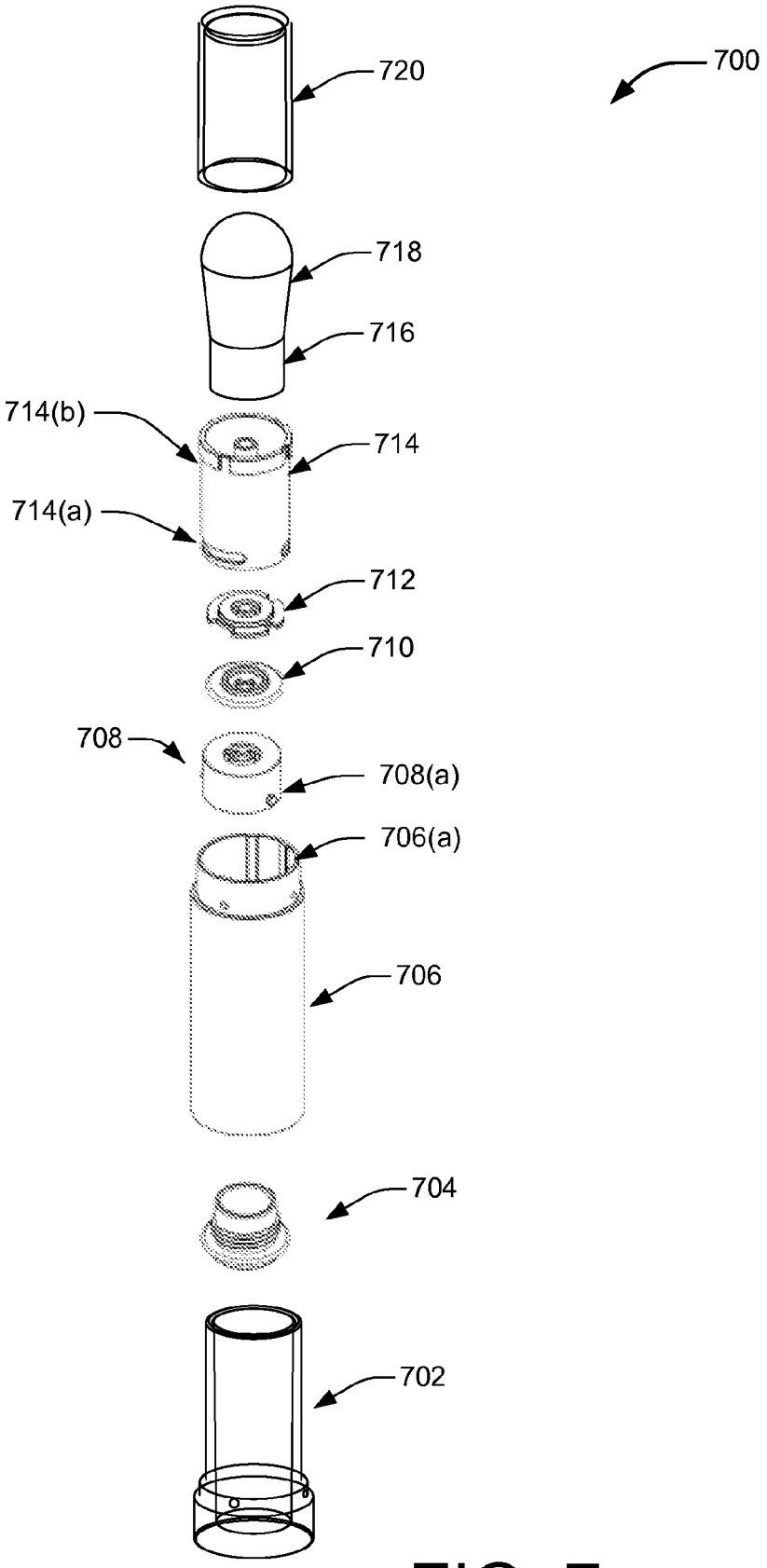
FIG. 7 is an exploded view of another illustrative dispenser with a cam path according to one implementation.

FIG. 7 is an exploded view of another implementation of a dispenser with a cam path. The following is a discussion of examples, without limitation, according to one implementation. FIG. 7 illustrates the dispenser having a cam path in an actuator 700. An actuator selectively moves the dispenser in a spiral motion between an upward position and a downward position. A vertical movement is guided by a slot in an actuator and a flange in a slide. In this implementation, the dispenser 700 may also rotate to an open position and a closed position. A mating guide pin in the lower valve travels along the cam path in the actuator. This rotation causes at least one aperture in the flow-through compressible gasket with an hour-glass shape to be alignable with at least one aperture in an upper valve and/or an lower valve, and the mating guide pin and the cam path are in a downward slanted position to decompress the flow-through compressible gasket, to define a product passageway. Furthermore, the dispenser 700 may rotate to a closed position. The mating guide pin travels along the cam path located in the actuator, the rotation causes the at least one aperture in the flow-through compressible gasket with the hour-glass shape to be alignable with a smooth area or raised sections of the lower valve and/or the upper valve, and the mating guide pin and the cam path are in an upward slanted position. This position increases the effectiveness of a seal by causing a compression against the flow-through gasket to provide a seal to prevent product loss. For ease of convenience, the term "flow-through compressible gasket with an hour-glass shape" may be used interchangeably with a shortened version of "flow-through compressible gasket H".

FIG. 7 represents the illustrative dispenser 700 having a housing 702 with a reservoir to contain the product and an end cap 704. The housing 702 has a ridge at the bottom, the reservoir may be refillable with product by removing the end cap 704 to refill product. In some instances, the housing 702 may be made of clear, substantially opaque, or translucent materials. In an implementation, the housing and the end cap may be molded together. When the housing and the end cap are molded together, the reservoir is filled at the top of the housing.

The dispenser 700 includes a slide 706 that covers the various components of the dispenser. The slide includes a flange 706(*a*) to be coupled to a slot, that allows the dispenser to selectively move in a vertical movement between an upward position and a downward position. In another implementation, the slide 706 selectively moves with a sliding motion to an upward position to expose an applicator brush to apply product and to a downward position to retract the applicator brush. A user selectively rotates the slide 706 as it travels along the flange 706(*a*) in conjunction with the slot along a vertical motion to the upward position. This vertical action moves an upper portion of the dispenser upwards, by rotating the applicator upwards for applying the product. Furthermore, the user selectively rotates the slide 706 as the dispenser travels along the flange 706(*a*) in conjunction with the slot through the vertical motion to the downward position to retract the applicator brush.

The dispenser includes a lower valve or an inner valve 708, a flow-through compressible gasket with an hour-glass shape 710, and an upper valve or an outer valve 712. The lower valve 708 may be secured to the housing 704 and to the slide 706, by, for example, a press-fit, a snap-fit, adhesive, and/or engagement by one or more engagement features. In the illustrated implementation, the lower valve 708 may include a mating guiding pin 708(*a*). The lower valve 708 also includes a center-raised section that has a plurality of smooth areas alternating with at least one aperture. In some implementations, the dispenser does not include the flow-through compressible gasket with the hour-glass shape.

Furthermore, the dispenser 700 includes an actuator 714 with at least one or more cam path(s) 714(*a*) and at least one or more slot(s) 714(*b*), an aperture and at least one or more ridges around the external circumference of the actuator 714. The one or more cam path(s) 714(*a*) allow the at least one or more mating guiding pin(s) 708(*a*) of the lower valve 708 to travel along the one or more cam path(s) 714(*a*). The one or more slot(s) 714(*b*) and the flange 706(*a*) guide the vertical movement of the dispenser.

An upper assembly may include the actuator 714 and the upper valve 712. The actuator 714 may include at least one post to help define the product delivery passageway. The actuator 714 may be secured to the upper valve 712 including but not limited to, a press-fit, a snap-fit, adhesive, and/or engagement by one or more engagement features. Also, the actuator 714 may include at least one or more ridges around the external circumference for ease of convenience for the user to rotate the actuator.

The following is a discussion of examples, without limitation, of delivery mechanisms for dispensing the product in the open position and of preventing product leakage in the closed position, as the mating guide pin 708(*a*) travels along the cam path 714(*a*) in the actuator. The examples may be implemented using a rotation or a reverse rotation operation, a spiral motion or a reverse spiral motion, whereby the user may operate the dispenser 700 by moving the actuator 714 or the slide 706, causing the mating guide pin 708(*a*) to travel along the cam path 714(*a*) in either a clockwise or a counterclockwise direction. The rotations may move from left to right and/or right to left. The opened and closed positions may apply to rotations which include but are not limited to, clockwise and/or counterclockwise directions, left and/or right movements, up and/or down motions, and the like.

In implementations with the flow-through compressible gasket 710, the mating guide pin 708(*a*) travelling in the cam path 714(*a*) provides a mechanism for the apertures in flow-through compressible gasket 710 and the apertures in the lower valve 708 to align with the apertures in the upper valve 712 to move the dispenser from open to close states and vice versa. This occurs with the dispenser being selectively rotatable in a spiral motion between i) an open position as the open state and ii) a closed position as the closed state. As previously mentioned, the dispenser being selectively rotatable in the vertical motion between i) the upward position and ii) the downward position, along with this spiral motion for the open and closed positions.

In implementations with the flow-through compressible gasket 710, the mating guide pin 708(*a*) in the lower valve 708 travels along the cam path 714(*a*) in the downward slanted position. The mating guide pin 708(*a*) in the cam path 714(*a*) travels to a downward slant when the dispenser is selectively rotatable in the spiral motion to the open position. Here, the flow-through compressible gasket 710 with the lower valve 708 in this downward slanted position is in the open position to allow for product delivery. The spiral motion to the open position may cause the lower valve 708 to move further apart from the upper valve 712. For example, the at least one or more apertures in the upper valve 712 selectively aligns with the at least one or more apertures of the lower valve 708 and with at least one or more apertures in the flow-through compressible gasket. This alignment along with the downward slant of the mating guiding pin 708(*a*) and the cam path 714(*a*) create the open position, the downward slant of the cam path 714(*a*) decompresses the flow-through compressible gasket 710, to allow the dispenser to be in the open state. The cam path 714(*a*) increases the effectiveness of the open position by decompressing the flow-through compressible gasket 710 to allow product delivery.

The mating guiding pin 708(*a*) in the lower valve 708 travels along the cam path 714(*a*) in the upward slanted position when the dispenser is selectively rotatable in the spiral motion to the closed position. The cam path 714(*a*) in this upward slanted position rotates to a closed position for no product delivery. The spiral motion to the closed position may cause the lower valve to move closer to the upper valve. For example, the at least one raised section in the upper valve 712 is selectively alignable with the at least one aperture in a lower valve and with the aperture in the flow-through compressible gasket. This creates the closed position with the alignments along with the upward slanted position of the cam path 714 (*a*), the cam path increases the effectiveness of the closed position by causing a compression against the flow-through compressible gasket 710. This compression helps provide a seal for the dispenser in the closed state. For various implementations, the cam path slanted upwards or downwards may include either open or closed positions and vice versa. The rotation for the spiral motion may be clockwise or counter clockwise for the open or closed positions.

The spiral motions may cause the mating guide pin 708(*a*) in the lower valve 708 to travel along the cam path 714(*a*). This may cause the upper valve 712 to rotate upwards, to move away from the lower valve 708 in a clockwise or counterclockwise rotation. In another implementation, the spiral motion causing the mating guide pin 708(*a*) in the lower valve to travel along the cam path, may involve rotation of the upper valve or lower valve relative to each other. In another implementation, the spiral motion causing the mating guide pin 708(*a*) to travel along the cam path, may involve rotation of the upper valve while the lower valve remains stationary. In another implementation, the spiral motion causing the mating guide pin 708(*a*) to travel along the cam path, may involve rotation of the lower valve, while the upper valve remains stationary.

At least one aperture in the lower valve 708, the flow-through compressible gasket H 710, and the upper valve 712 may have shapes that include but are not limited to, substantially hour-glass shaped, substantially disk-shape, substantially circular-shape, substantially square-shape, substantially oval-shape, or substantially trapezoid shape.

The size of the apertures in the lower valve 708, the flow-through compressible gasket H 710, and the upper valve 712 is of a sufficient size and of an adequate opening to allow for product delivery without being plugged. For example, the size of the apertures may range from at least about 1 mm to at most about 5 mm. In one implementation, each aperture is at least about 2 mm in size.

The number of apertures in the lower valve 708, the flow-through compressible gasket H 710, and the upper valve 712 may range from at least one aperture to about four apertures.

The shape, size, and number of the apertures in the lower valve 708, the flow-through compressible gasket H 710, and the upper valve 712 may be different in relation to each other. For example, there may be one aperture in the flow-through compressible gasket and two apertures in each of the lower valve and the upper valve. Furthermore, the shape of the aperture(s) in the flow-through compressible gasket may be substantially hour-glass shape, in the lower valve may be disk-shape, and in the upper valve trapezoid shape. Any combination of shapes, size, and number of apertures are possible.

The plurality of raised areas in the lower valve 708 and/or upper valve 712 are alignable with the at least one aperture in the flow-through compressible gasket H 710, along with the upward slanted position of the cam path 714(*a*), the cam path 714(*a*) increases the effectiveness of a seal by causing a compression against the flow-through compressible gasket 710, to provide a seal for the dispenser to be in the closed position. This closed position prevents movement of the product along a delivery passageway due to the seal. Furthermore, the flow-through compressible gasket H 710 allows a controlled rate of product to be dispensed at one time without loose powder being distributed all over the user.

The end cap 702, the housing 704, the slide 706, the lower valve 708, the upper valve 712, and the actuator 714 may be constructed of materials including, but not limited to, wood, plastics, polymers, thermoplastics, composites thereof, or the like. In some implementations, the described components may be made at least partially of a resin such as, for example, acrylonitrile butadiene styrene (ABS), styrene acrylonitrile (SAN), pentachlorothioanisole (PCTA), polypropylene (PP), polyethylene (PE), polyurethane, combinations thereof, or the like.

FIG. 7 shows the dispenser 700 has an applicator. The applicator includes an applicator holder 716 coupled to the applicator 718. The applicator holder 716 serves as a base to hold a brush applicator 718 or as a base for a sponge or powder puff applicator.

In some implementations, the applicator may include a sponge which may include at least one aperture. The apertures may range in number from at least about one to at most about six apertures. The apertures in the sponge applicator (not shown) may range in size from at least about 1 mm to at most about 4 mm in diameter.

The dispenser 700 includes a removable cap 720 or a cover that is sized and shaped to fit over the top of the applicator 718. In an implementation, the removable cap 720 may snap onto the housing 704. In yet another implementation, the removable cap 720 may include threads to screw onto the housing 704 that mates with it. In some instances, the removable cap 720 may be made of clear, substantially opaque, or translucent materials. In other implementations, the dispenser 700 may include a clear plastic cover, a sliding pull up cover, and the like. In this illustration, the dispenser 700 includes the removable cap 720 that encapsulates the applicator 718 when the dispenser 700 is not in use. In another implementation, the dispenser may not include a removable cap or cover.

The removable cap 720 may include a mirror (not shown) for convenience of the user to have the mirror readily available when applying the product. The mirror may range in thickness from at least about two mm to at most about eight mm. In various implementations, the mirror may be coupled to the removable cap by adhesive, press fit, snap fit, one or more ribs or barbs, or any other suitable fastening means. The mirror may be located on the top, the side, or inside the removable cap. In another implementation, the dispenser 700 may not include a mirror.

While features of various illustrative implementations are described, in other implementations, the end cap 702, the housing 704, the slide 706, the lower valve 708, the upper valve 712, the actuator 714, the applicator holder 716, the applicator 718, and the cap 720 may be configured in any form suitable for the application of the product contained in the dispenser 700. For example, the above items listed may be constructed in any other suitable shape and size and may have any suitable mass, surface finish, and/or surface treatment desired for a given application. In practice, the above items listed may be configured in virtually any desired shape, such as disk-shaped, oval, elliptical, spherical, curvilinear, trapezoidal, or the like.

Figure 8A:
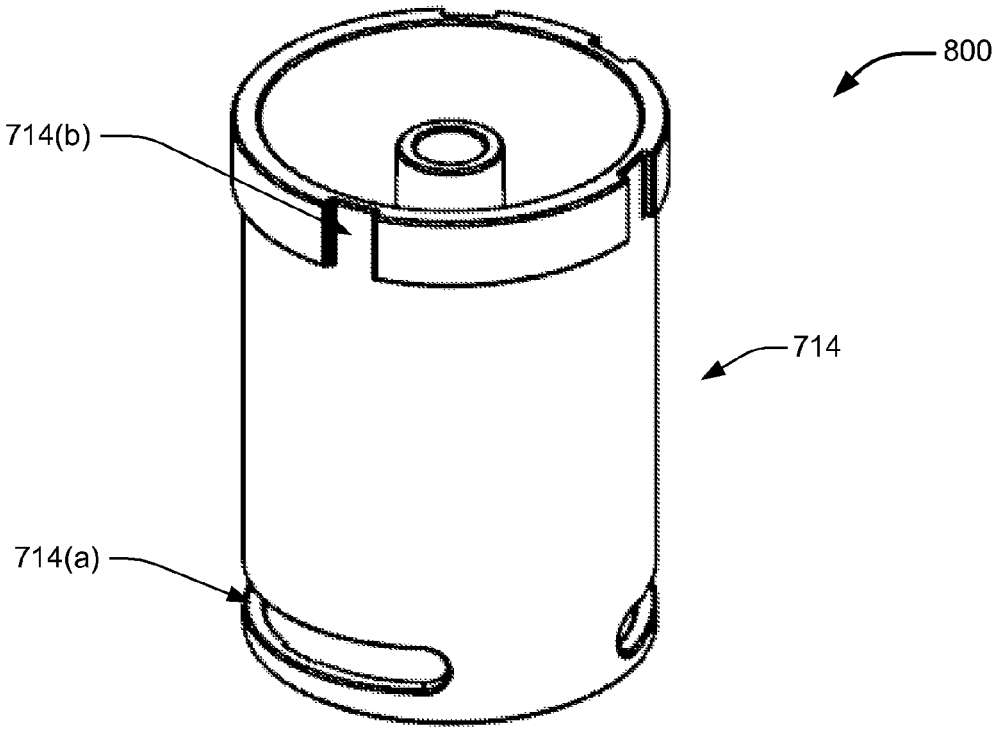
FIGS. 8*a* and 8*b* are a perspective view and a side view, respectively, of a cam path on an actuator of FIG. 7.
Figure 8B:
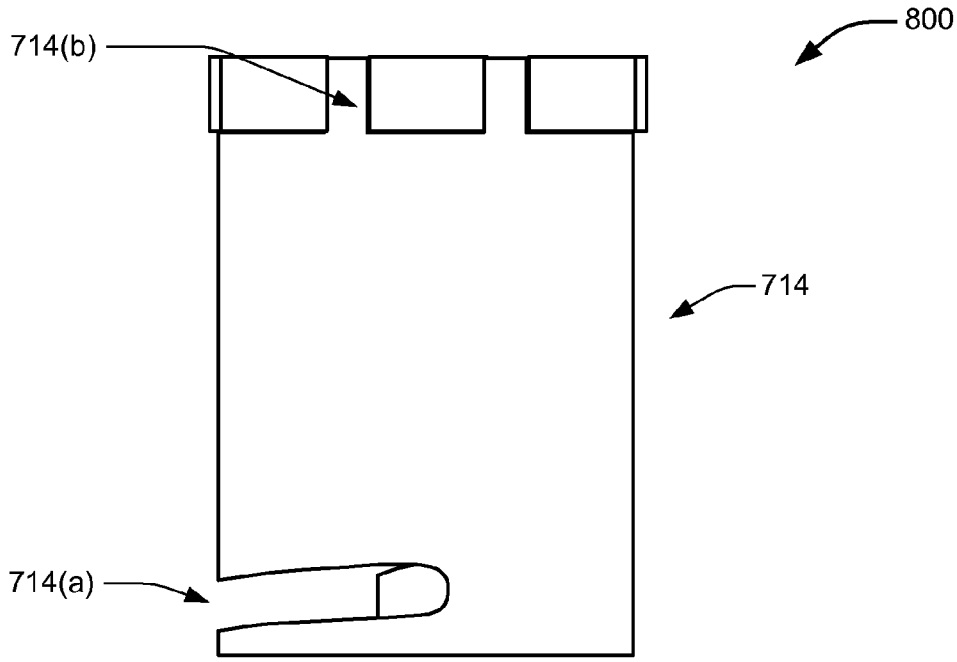

FIGS. 8*a* and 8*b* are a perspective view and a side view 800, respectively, of the cam path 714(*a*), slots 714(*b*) on the actuator 714 of FIG. 7. The discussion of the cam path 714(*a*), slots 714(*b*) on the actuator 714 were discussed in details in FIG. 7.

Figure 9A:
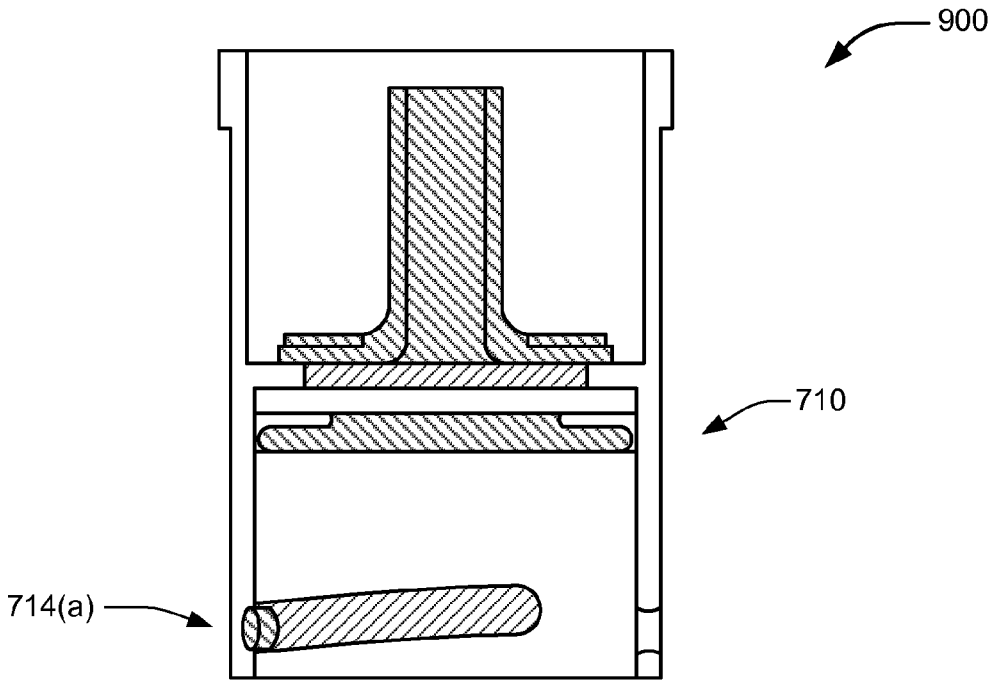
FIGS. 9*a* and 9*b* are cross sectional views of the cam path of FIG. 7.
Figure 9B:
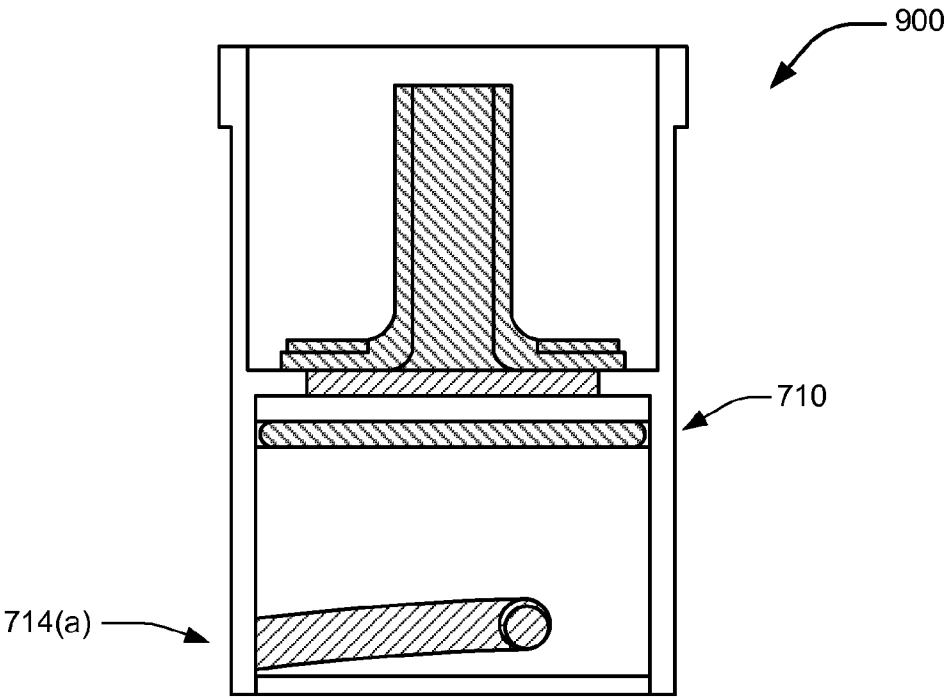

FIGS. 9*a* and 9*b* are cross sectional views 900 of the cam path 714(*a*) of FIG. 7. FIG. 9*a* shows the guiding pin in the cam path 714(*a*) is in the slanted downward position, causing the dispenser to be in the open position. Shown in FIG. 9*a*, the guide pin in the cam path 714(*a*) provides a decompression on the flow-through compressible gasket 710 for the open position. In FIG. 9*b*, the guide pin in the cam path 714(*a*) is in the slanted upward position, causing the dispenser to be in the closed position. In FIG. 9*b*, the guide pin in the cam path provides compression on the flow-through compressible gasket 710 for the closed position. Thus, the cam path 714(*a*) increases the effectiveness of the seal by this compression.

Flow-Through Compressible Gasket H

Figure 10A:
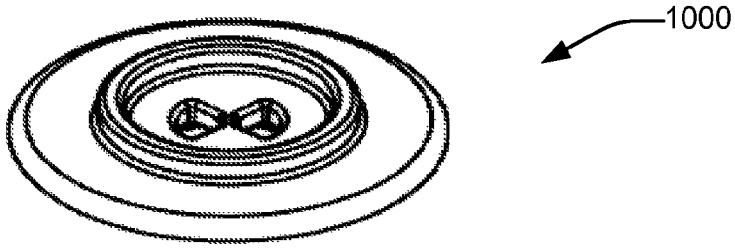
FIGS. 10*a*, 10*b*, and 10*c* are a top plan view, a front perspective view, and a side view respectively, of the illustrative flow-through compressible gasket according to an implementation.
Figure 10B:
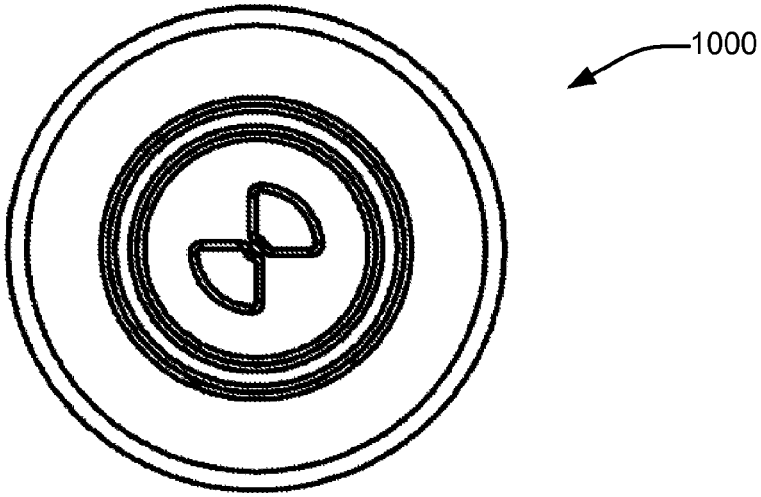
Figure 10C:
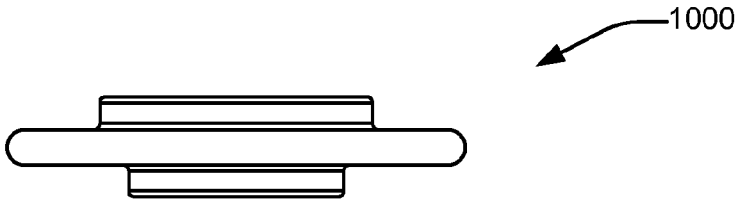

FIGS. 10*a*, 10*b*, and 10*c* are a front perspective view, a top plan view, and a side elevation view, respectively, of the flow-through compressible gasket. In these figures, the flow-through compressible gasket H includes apertures having a substantially hour-glass shape surrounded by circular rings on the top and the bottom sides of the gasket.

The flow-through compressible gasket with the hour-glass shape is made of a material capable of having both thermoplastic and elastomeric properties, including but not limited to a thermoplastic elastomer (TPE), a thermoplastic rubber, a thermoplastic polymer, an elastomer, and the like. In some implementations, the elastomeric material may comprise polyurethane, polyester copolymer, styrene copolymer, olefin, ethylene acrylic, chlorinated polyethylene, chlorosulfonated polyethylene, fluorocarbon, while in other implementations, the elastomeric material may comprise a relatively pliable or gel-like material such as butyl rubber, silicone, butadiene rubber, neoprene, nitrile, fluorosilicone, styrene-butadiene rubber (SBR), or the like.

FIG. 10*a* illustrates a front perspective view of the flow-through compressible gasket with the hour-glass shape. FIG. 10*a* illustrates how the flow-through compressible gasket H includes a substantially circular-shaped body with a raised center section. The body and the raised center section may be in other configurations and shapes, including but not limited to substantially circular-shaped, substantially square-shaped or substantially oval-shaped.

The flow-through compressible gasket with the hour-glass shape includes at least one aperture located on the substantially circular-shaped body. The at least one aperture aligns with the at least one aperture of the lower valve and the at least one aperture of the upper valve to deliver the product. The at least one aperture in the flow-through compressible gasket with the hour-glass shape may have shapes that includes but are not limited to, substantially circular, substantially square-shaped, or substantially oval-shaped. In this illustration, the at least one aperture is substantially hour-glass shape.

The number of the at least one aperture is of a sufficient number to allow for product delivery, but is dependent on the size of the aperture. In an implementation, the at least one aperture may include two apertures. In other implementations, the at least one aperture may include but is not limited to, from at least one aperture to at most four apertures. The arrangement of the at least one aperture may be of a hour-glass shape formation with two apertures as shown in FIG. 10*b* or a circular shaped with three apertures at least 2 mm diameter.

FIG. 10*c* illustrates a side view of the flow-through compressible gasket with the hour-glass shape. The flow-through compressible gasket with the hour-glass shape includes a first circular ring connecting to the substantially circular-shaped body on one side and a second circular ring connecting to the substantially circular-shaped body on the other side.

While features of various illustrative implementations are described, in other implementations, the flow-through compressible gasket with the hour-glass shape may be configured in any form suitable for the application of the product contained in the dispenser 800. For example, the flow-through compressible gasket with the hour-glass shape may be constructed in any other suitable shape and size and may have any suitable number of apertures, size of apertures, shape of apertures desired for a given application. Fabrication of the dispenser and the flow-through compressible gasket with the hour-glass shape may be accomplished through a separate manufacturing process, a co-molding process, or any other suitable production process. Fabrication of dispenser and flow-through compressible gasket with the hour-glass shape may be accomplished through a separate manufacturing process, a co-molding process, or any other suitable production process.

Figure 11A:
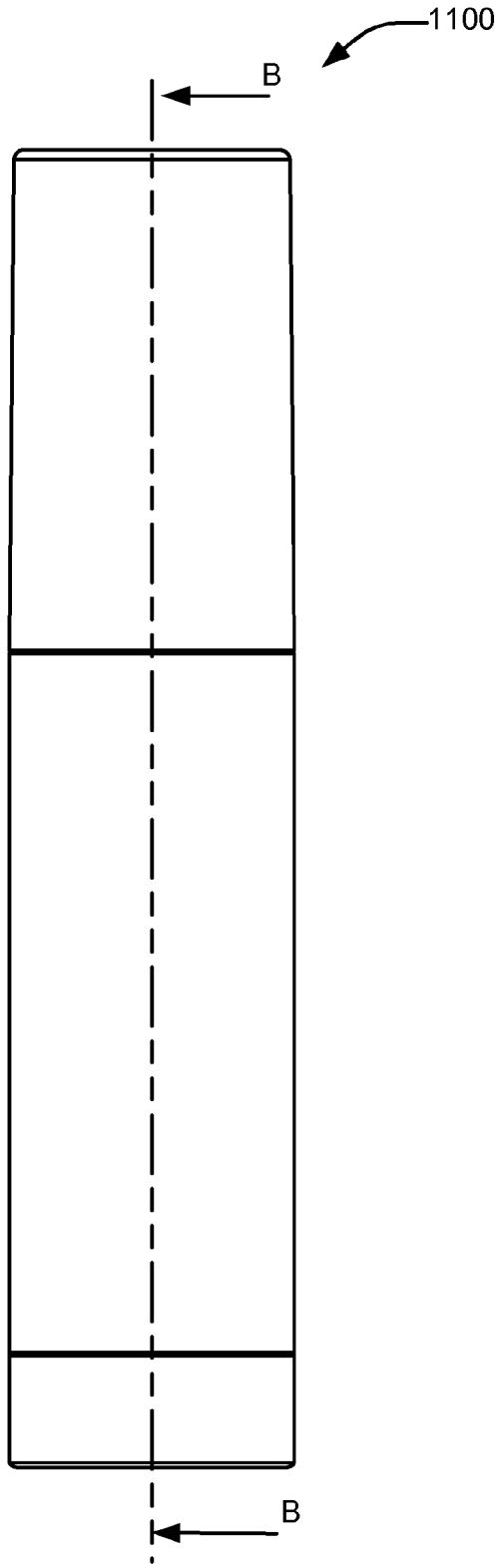
FIGS. 11*a* and 11*b* are a side view and a cross-sectional view, respectively taken along line B-B of the illustrative dispenser of FIG. 7.
Figure 11B:
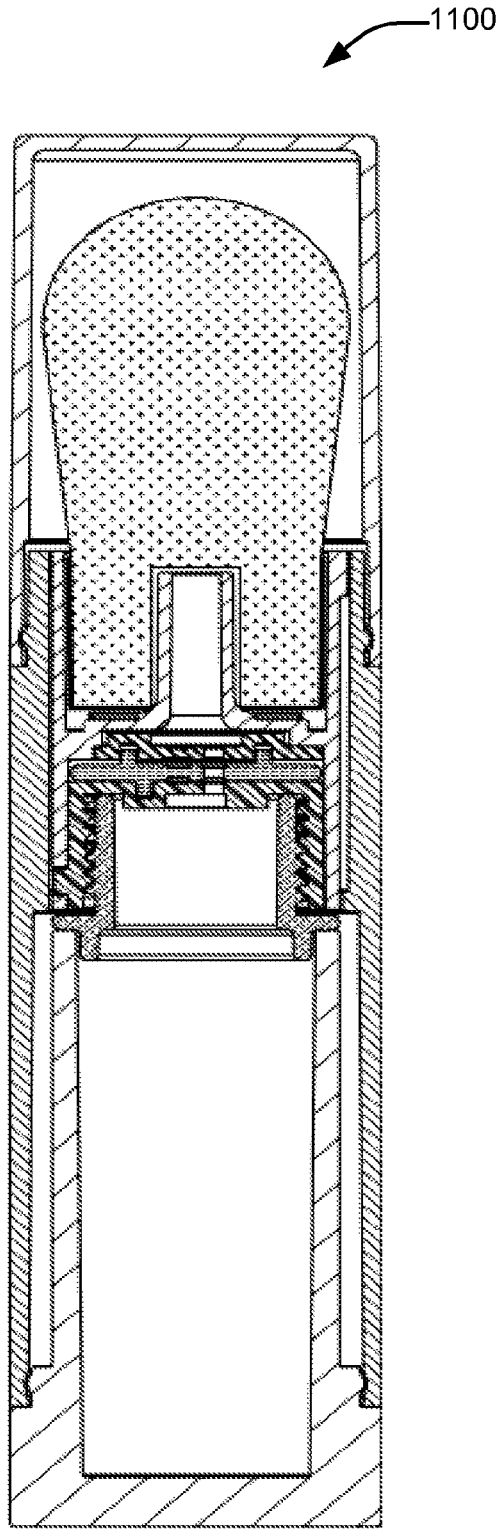

Illustrative Delivery Mechanism for Flow-Through Compressible Gasket with Hour-Glass Shape FIG. 11*a* is a side view and FIG. 11*b* is a cross-sectional view taken along line B-B of the illustrative flow-through dispenser of FIG. 7.

The following is a discussion of examples, without limitation, of delivery mechanisms for dispensing a product in the open position and of preventing product leakage in the closed position. The examples may be implemented using a rotation or reverse rotation operation, whereby a user may operate the dispenser by moving the mating guide pin relative to the cam path along with the lower valve in either a clockwise or a counterclockwise direction. However, in other implementations, any suitable delivery mechanism may be used.

In one example, the actuator serves as an operating mechanism to allow product delivery in the open position. The rotation of the actuator to the open position causes the mating guide pin in the lower valve to travel along the cam path. For example, at least one aperture of the flow-through compressible gasket H with the hour-glass shape to align with the at least one aperture in the lower valve or the upper valve, such that the product is transported through this product delivery passageway. The product is dispensed from the reservoir in the housing through to the applicator.

In one example, the actuator serves as an operating mechanism to prevent product leakage causes the mating guide pin in the lower valve to travel along the cam path. For example, the at least one or more raised sections in the upper valve or the lower valve aligns with the at least one or more apertures in the flow-through compressible gasket with hour-glass shape aligns to create no delivery passageway. Furthermore, the mating guide pin travelling in the cam path is in a slanted upward position, the cam path creating compression against the flow-through compressible gasket with hour-glass shape for the closed position. In this closed position, the cam path in the actuator provides a seal by aligning smooth areas or raised sections on the upper valve and/or the lower valve to the at least one aperture of the flow-through compressible gasket H, along with the compression. Thus, the closed position prevents product leakage by sealing the product delivery passageway.

In some implementations, the rotation mechanism may include a rotation at least about 1 degrees to at most about 359 degrees to the open position along the cam path. In other implementations, the rotation mechanism may include a rotation at a minimum of at least about 5 degrees to at most about 350 degrees along the cam path. Another example for delivery mechanism for dispensing the product may be a rotation of at least about 180 degrees, relative to a sufficient number of the at least one aperture and a sufficient size of the at least one aperture in the flow-through compressible gasket H. The delivery mechanism include but is not limited to, clockwise or counter clockwise rotations, left or right movements, opened or closed positions, and the like.

Actuation may also occur by turning, depressing, sliding, tilting, or otherwise manipulating an outer cover, a knob on an outer cover, and/or by any other suitable dispensing mechanism. In an implementation, a knob on the outer cover allows product delivery. This may occur by sliding the knob to align the at least one aperture in the flow-through compressible gasket with a at least one aperture in the outer cover. However, in other implementations, any suitable delivery mechanism may be used.

Illustrative Dispenser with Two Cam Paths

Figure 12:
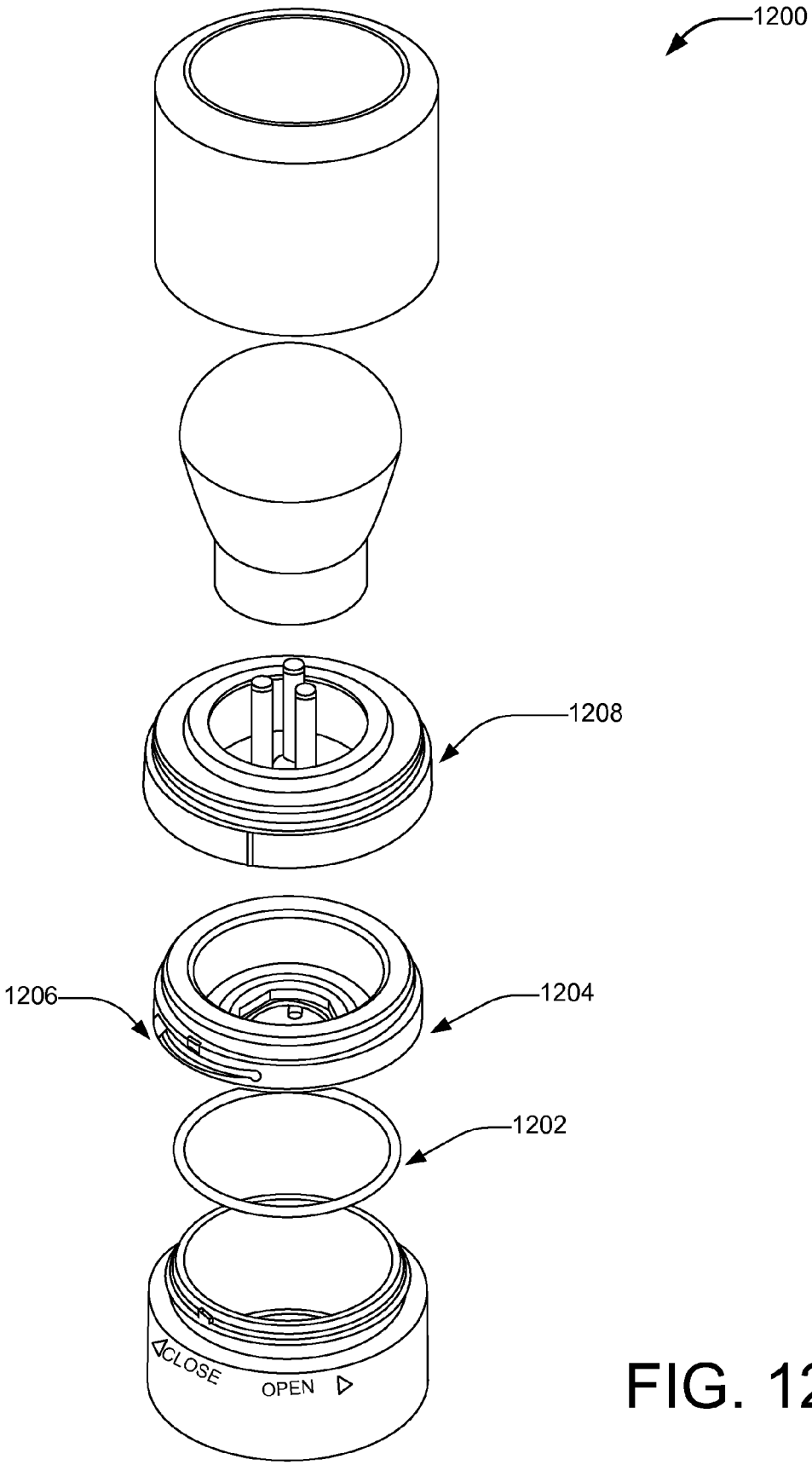
FIG. 12 is an exploded view of another illustrative implementation of a dispenser with a cam path.

FIGS. 12-15 illustrate other implementations of dispenser with cam paths. FIG. 12 is an exploded view of another illustrative implementation of a dispenser with at least two cam paths. It is understood these illustrative dispensers with cam paths have features similar to the components and features of the dispensers as discussed in FIGS. 1 and 7. However, the following descriptions will focus on features that are different for other implementations of the dispensers with cam paths.

In this implementation of FIG. 12, the dispenser 1200 includes an o ring seal 1202. The o-ring seal 1202 is illustrated as being generally ring or circular-shape. However, the o-ring seal 1202 may be configured in virtually any desired shape, such as oval, elliptical, spherical, curvilinear, trapezoidal, or the like. The o-ring seal 1202 is snapped fit to the lower valve to the housing to form a seal. The o-ring seal 1202 may be made of materials including but not limited to, nitrile rubber, Buna-N, synthetic rubber copolymer of acrylonitrile and butadiene, thermoplastic elastomer (TPE), silicon, and the like.

The dispenser includes a lower valve 1204, which may include one or more apertures to transport product from the reservoir in the housing to an applicator for product delivery. The lower valve 1204 also includes one or more raised sections alternating with the one or more apertures. The one or more raised sections include but are not limited to, made of the same material as the lower valve 1204, formed of over molded thermoplastic elastomeric material, made of a plurality of raised bumps, made of a small layer, or made of thermoplastic elastomeric rings surrounding the bumps or the raised sections.

The lower valve 1204 includes at least one or more cam paths 1206. In an implementation, there are two cam paths on the lower valve, located about 180 degrees relative to each other. There are mating guide pins (not shown) located in the upper valve 1208 that fits along the cam paths to limit the amount of rotation (similar to FIG. 2). For example, the amount of spiral rotation may be limited to less than about 180 degrees. In other implementations, the amount of rotation may be greater than about 180 degrees to about 250 degrees.

Figure 13:
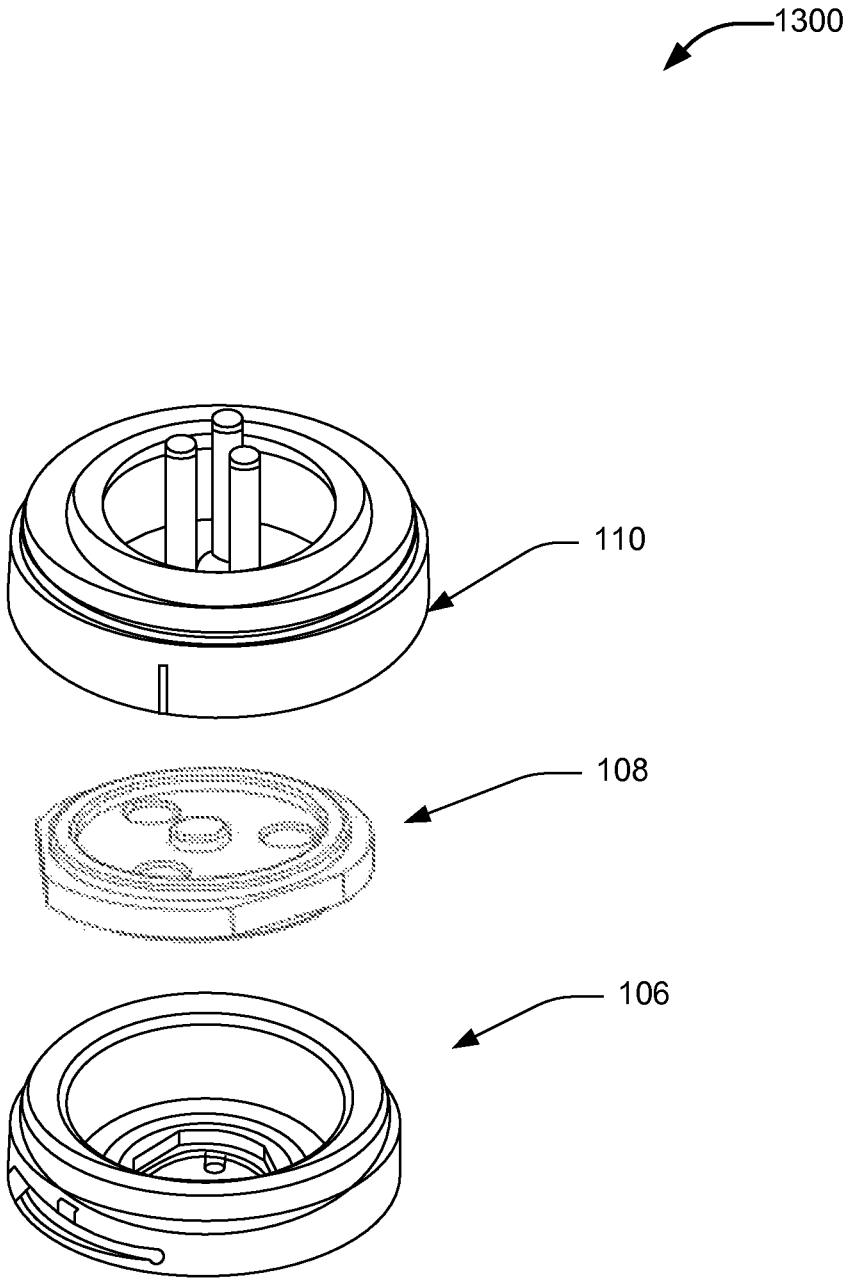
FIG. 13 is perspective view of an upper valve, flow-through compressible gasket, and a lower valve, according to the implementation of FIG. 12.
Figure 14:
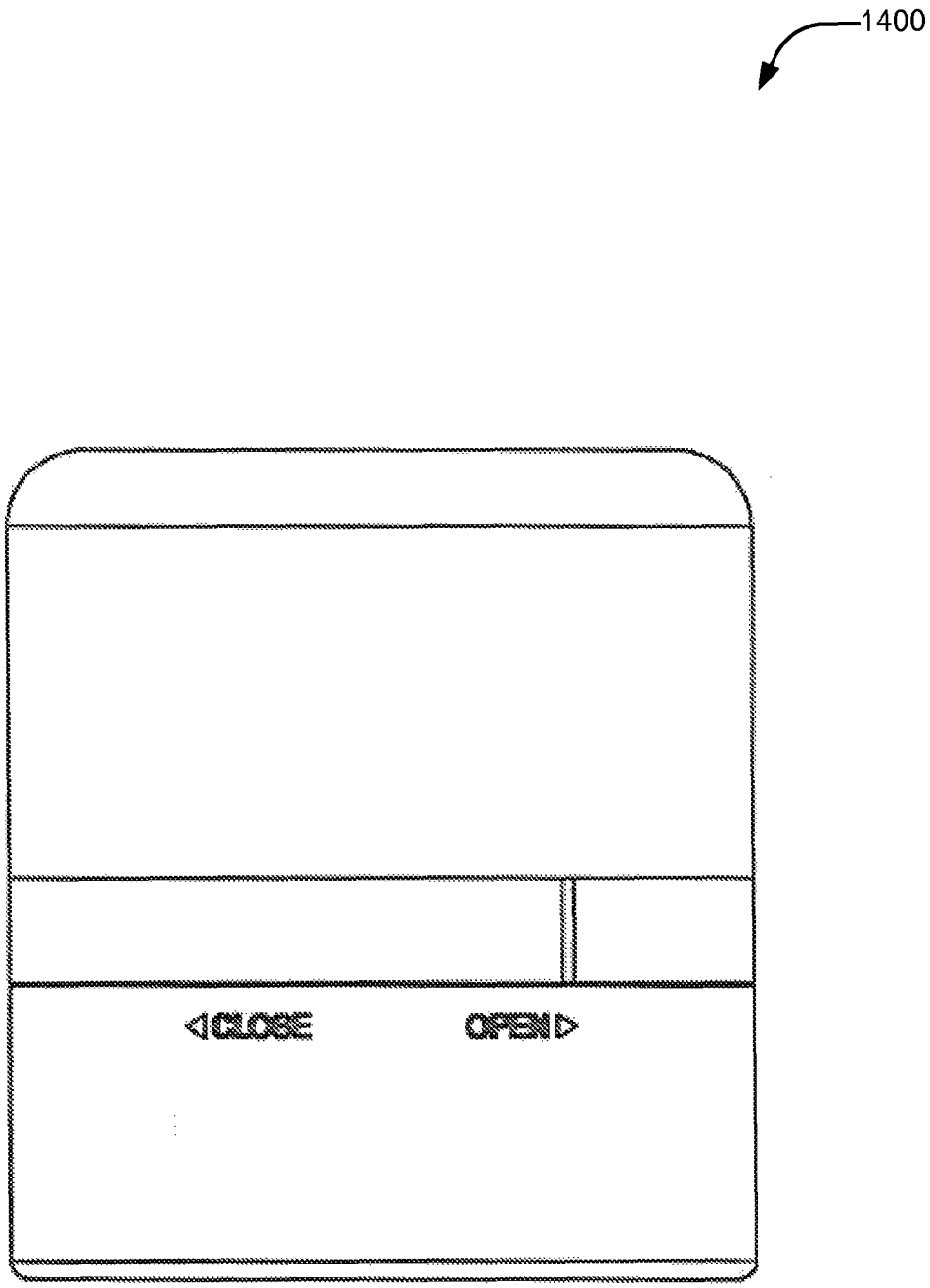
FIG. 14 is an exterior view of the illustrative dispenser of FIG. 12.

FIG. 13 is perspective view 1300 of an upper valve, flow-through compressible gasket, and a lower valve, according to the implementation of FIG. 12. FIG. 14 is an exterior view 1400 of an illustrative dispenser of FIG. 12.

Illustrative Dispenser with Cam Paths

Figure 15:
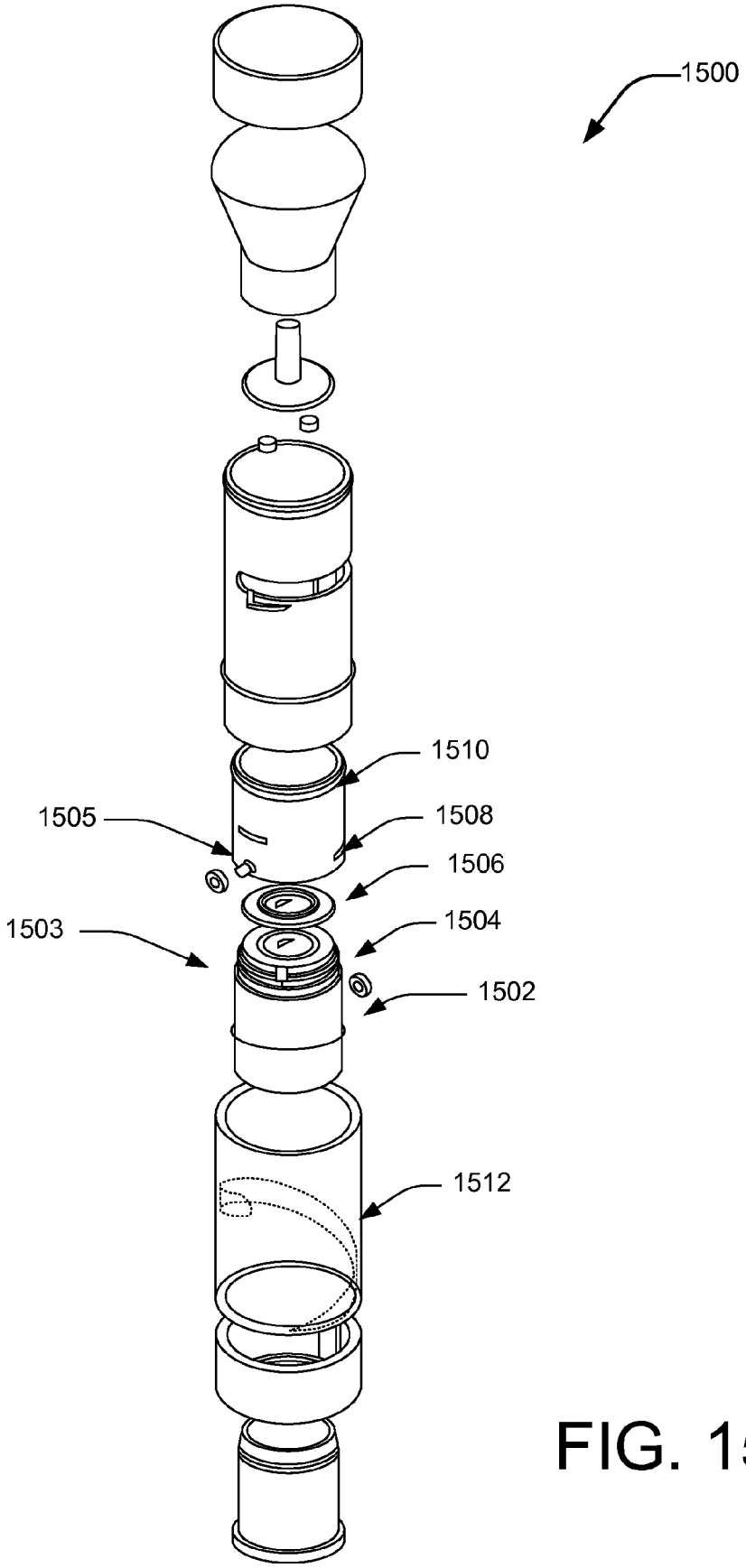
FIG. 15 is an exploded view of another illustrative implementation of a dispenser with a cam path.

FIG. 15 is an exploded view of another illustrative implementation of a dispenser 1500 with a cam path. It is understood this illustrative dispenser with cam path has features similar to the components and features of the dispensers as discussed in FIGS. 1, 7 and 12. However, the following descriptions will focus on features that are different for other implementations of the dispensers with cam paths.

In this implementation of FIG. 15, the dispenser includes a lower valve 1502, a first guide pin 1503, and a first cam path 1504, both shown on the lower valve. The dispenser may or may not include a flow-through compressible gasket 1506. The dispenser also includes a second guide pin 1505 and a second cam path 1508, both are located on an upper valve 1510.

There are two types of spiral motions that occur with the dispenser 1500. In one implementation, the first guide pin 1503 in the lower valve 1502 travels along the second cam path 1508 in the upper valve 1510 in an upward rotation. The spiral upward motion in the second cam path 1508 occurs in conjunction with a helical motion along the helical guide slot 1512. In another implementation, the second guide pin 1505 in the upper valve 1510 travels along the first cam path 1504 in the lower valve 1502 in a downward rotation. The spiral downward motion in the first cam path 1504 occurs in conjunction with the helical motion along the helical guide slot 1512.

Conclusion

Although the invention has been described in language specific to structural features and/or methodological acts, it is to be understood that the invention is not necessarily limited to the specific features or acts described. Rather, the specific features and acts are disclosed as illustrative forms of implementing the invention.

What is claimed is:

1. A cosmetic dispenser comprising:

a lower valve having a reservoir for containing a product, the lower valve having at least one aperture;

an upper valve coupled to the lower valve;

at least one cam path located on the lower valve;

at least one guide pin located on the upper valve coupled to the at least one cam path;

a collar that covers the lower valve and the upper valve;

the dispenser being selectively guidable in a motion between:

i) an upward position for the dispenser to expose an applicator, and ii) a downward position to store the applicator;

the applicator coupled to the upper valve for applying the product;

the dispenser being selectively rotatable with the at least one guide pin in the at least one cam path between:

i) an open position for the dispenser to deliver the product, and ii) a closed position to seal a delivery passageway;

wherein in the open position at least one aperture in the upper valve is aligned with the at least one aperture in the lower valve for product delivery; and wherein in the closed position at least one raised section in the upper valve is aligned with the at least one aperture in the lower valve to seal delivery passageway.

2. The cosmetic dispenser of claim 1, further comprising a flow-through compressible gasket coupled to the lower valve and the upper valve, the dispenser being selectively guidable with the at least one guide pin in and the at least one cam path between:

an upward slanted position, wherein the flow-through compressible gasket is selectively decompressed to allow for dispensing the product;

a downward slanted position, wherein the flow-through compressible gasket is selectively compressed to provide a seal for preventing the product from leaking; and a flat unslanted position, wherein the flow-through compressible gasket is not compressed while the at least one aperture in the lower valve is selectively aligned with the at least one raised section in the upper valve.

3. The cosmetic dispenser of claim 1, further comprising a flow-through compressible gasket coupled to the lower valve and the upper valve, the flow-through compressible gasket comprises:

a substantially disk-shaped body with a top raised center section on a top side and a bottom raised center section on a bottom side; and at least one aperture being located on the substantially disk-shaped body and being alignable with the at least one aperture of the lower valve and with the at least one aperture of the upper valve to define a delivery passageway for the product.

4. The cosmetic dispenser of claim 3, wherein the flow-through compressible gasket further comprises:

a first circular ring surrounding the at least one aperture on the bottom side of the substantially disk-shaped body;

a second circular ring surrounding the at least one aperture on the top side of the substantially disk-shaped body; and an outer perimeter comprising a plurality of flat sides and a plurality of semicircular sides alternating on the substantially disk-shaped body.

5. The cosmetic dispenser of claim 1, further comprising a flow-through compressible gasket coupled to the lower valve and the upper valve, the flow-through compressible gasket made of a thermoplastic elastomer (TPE) material.

6. The cosmetic dispenser of claim 1, further comprising another guide pin located on the upper valve to travel against another cam path located on the lower valve.

7. The cosmetic dispenser of claim 1, further comprising another guide pin located on the upper valve at about 180 degrees to the at least one guide pin to travel against another cam path located on the lower valve located at about 180 degrees to the at least one cam path.

8. The cosmetic dispenser of claim 1, wherein the motion between the upward slanted and downward positions comprises an actuation of at least about 10 degrees to at most about 300 degrees.

9. A cosmetic dispenser comprising:

a lower valve having a reservoir for containing a product, the lower valve having at least one aperture;

an upper valve coupled to the lower valve;

at least one guide pin located on the lower valve;

at least one cam path located on the upper valve coupled to the at least one mating guide pin;

the dispenser being selectively guidable along a helical guide slot between:

i) an upward position for the dispenser to apply the product, and ii) a downward position to retract the dispenser; and the dispenser being selectively guidable with the at least one guide pin located on the lower valve travelling along the cam path between:

i) an upward slanted position in which the dispenser is in an open state, wherein the at least one aperture in the lower valve is selectively aligned with at least one aperture in the upper valve, and ii) a flat unslanted position in which the dispenser is in a closed state, wherein the at least one aperture in the lower valve is selectively aligned with at least one raised section in the upper valve; and an applicator for applying the product.

10. The cosmetic dispenser of claim 9, further comprising:

an upper guide pin located on the upper valve, the upper guide pin being selectively rotatable along a helical motion;

a flow-through compressible gasket coupled to the lower valve and the upper valve, the dispenser being selectively guidable along the cam path in the helical motion between:

an upward slanted position, wherein the flow-through compressible gasket is selectively decompressed to allow for dispensing the product;

a downward slanted position, wherein the flow-through compressible gasket is selectively compressed to provide a seal for preventing the product from leaking; and the flat unslanted position, wherein the flow-through compressible gasket is not compressed, while the at least one aperture in the lower valve is selectively aligned with the at least one raised section in the upper valve.

11. The cosmetic dispenser of claim 9, further comprising a flange located on a slide to couple to a slot located on an actuator, the flange and the slot guide the dispenser in a vertical movement.

12. A dispenser comprising:

a lower valve having a reservoir for containing a product, the lower valve having at least one aperture;

an upper valve coupled to the lower valve;

at least one cam path located on the lower valve;

at least one guide pin located on the upper valve coupled to the at least one cam path located on the lower valve;

at least one cam path located on the upper valve;

at least one guide pin located on the lower valve coupled to the at least one cam path located on the upper valve;

the dispenser being selectively rotatable along the two cam paths between:

i) an open position for the dispenser to deliver the product, wherein the at least one aperture in the upper valve selectively aligns the at least one aperture in a flow-through compressible gasket with at least one aperture in the lower valve to create a delivery passageway; and ii) a closed position to seal a delivery passageway, wherein at least one raised section in the upper valve selectively aligns with the at least one aperture in the lower valve, such that the delivery passageway is closed to prevent product leakage.

13. The dispenser of claim 12, wherein the flow-through compressible gasket is interposed between the lower valve and the upper valve, the flow-through compressible gasket comprising at least one aperture and comprising an elastomer material.

14. The dispenser of claim 12, wherein the two cam paths are located about 180 degrees relative to each other and the two guide pins are located about 180 degrees relative to each other.

15. The dispenser of claim 12, further comprising a flange located on a slide that covers the components, the flange being coupled to a slot located on an actuator that selectively rotates the dispenser, wherein the flange and the slot guide the dispenser in a vertical movement.

* * * * *